US010106177B2

(12) United States Patent
Winston et al.

(10) Patent No.: US 10,106,177 B2
(45) Date of Patent: Oct. 23, 2018

(54) SYSTEMS AND METHOD FOR A TRACTION SYSTEM

(71) Applicant: General Electric Company, Schenectady, NY (US)

(72) Inventors: Justin Winston, Hermosa Beach, CA (US); Adrian Jerzy Gorski, Erie, PA (US); Bret Dwayne Worden, Erie, PA (US); Brian Douglas Lawry, Murrysville, PA (US); Matthew John Malone, Boulder, CO (US); Jennifer Lynn Coyne, Lawrence Park, PA (US); Jeremy Thomas McGarry, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/331,135

(22) Filed: Oct. 21, 2016

(65) Prior Publication Data

US 2017/0036681 A1 Feb. 9, 2017

Related U.S. Application Data

(63) Continuation-in-part of application No. 14/460,502, filed on Aug. 15, 2014, now Pat. No. 9,718,480.
(Continued)

(51) Int. Cl.
*B61C 15/08* (2006.01)
*B61C 15/10* (2006.01)
*B61C 17/12* (2006.01)

(52) U.S. Cl.
CPC ..... *B61C 15/08* (2013.01); *B61C 15/107* (2013.01); *B61C 17/12* (2013.01)

(58) Field of Classification Search
None
See application file for complete search history.

(56) References Cited

U.S. PATENT DOCUMENTS 77,602 A 5/1868 Floyd
490,269 A 1/1893 Chisholm
(Continued)

FOREIGN PATENT DOCUMENTS

BE 540032 A 8/1955
CN 2170241 Y 6/1994
(Continued)

OTHER PUBLICATIONS

Worden B.D., Adhesion control system and method, GE U.S. Appl. No. 61/866,404, filed Aug. 15, 2013.
(Continued)

*Primary Examiner* — Rami Khatib
(74) *Attorney, Agent, or Firm* — GE Global Patent Operation; John A. Kramer

(57) ABSTRACT

Examples for a traction system are provided. In one example, the traction system includes a nozzle coupled to an air source and configured to be selectively aimed toward a determined portion of a rail surface of a rail, and a conduit configured to supply pressurized air from the air source to the nozzle, the nozzle flexibly coupled thereto. The nozzle is configured for the aim of the nozzle to be controlled to change its aiming direction in response to a change in curvature of the rail, whereby a stream of air from the nozzle impacts the determined portion during movement of the vehicle through the curvature of the rail.

13 Claims, 26 Drawing Sheets

Related U.S. Application Data

(60) Provisional application No. 62/245,586, filed on Oct. 23, 2015, provisional application No. 61/866,248, filed on Aug. 15, 2013.

(56) References Cited

U.S. PATENT DOCUMENTS

| | | | | |
|---|---|---|---|---|
| 893,878 | A | 7/1908 | Shires | |
| 1,486,578 | A | 3/1924 | Harney | |
| 1,951,553 | A | 3/1934 | Martin | |
| 1,993,145 | A | 3/1935 | Kirk | |
| 2,597,719 | A | 5/1952 | Foster | |
| 2,606,781 | A | 8/1952 | Loftus | |
| 2,654,622 | A | 10/1953 | Foster | |
| 3,020,071 | A | 2/1962 | Makinson | |
| 3,345,097 | A | 10/1967 | Smith | |
| 3,345,098 | A | 10/1967 | Kilgore et al. | |
| 4,044,921 | A * | 8/1977 | Caverly | B65D 88/68 141/391 |
| 4,108,077 | A | 8/1978 | Laing | |
| 4,230,045 | A | 10/1980 | Fearon | |
| 4,434,719 | A | 3/1984 | Mekosh, Jr. | |
| 4,747,627 | A * | 5/1988 | Shigeura | B61C 15/102 239/290 |
| 4,781,121 | A | 11/1988 | Kumar et al. | |
| 5,119,991 | A | 6/1992 | Divers | |
| 5,251,724 | A | 10/1993 | Szatkowski et al. | |
| 5,580,106 | A | 12/1996 | Dulberg et al. | |
| 5,919,295 | A | 7/1999 | Lamba et al. | |
| 6,148,732 | A * | 11/2000 | Conway | B61K 3/00 104/279 |
| 6,629,709 | B1 | 10/2003 | Tunley et al. | |
| 6,797,918 | B1 | 9/2004 | Higgins | |
| 6,976,713 | B2 | 12/2005 | Kish et al. | |
| 7,152,888 | B2 | 12/2006 | Kumar et al. | |
| 7,529,614 | B1 * | 5/2009 | Muller | F02B 37/16 123/559.1 |
| 7,594,682 | B2 | 9/2009 | Kumar et al. | |
| 8,073,591 | B2 | 12/2011 | Bartling | |
| 8,500,177 | B2 | 8/2013 | Bartling | |
| 9,200,420 | B2 * | 12/2015 | Bramlett | E01H 8/105 |
| 9,421,984 | B2 * | 8/2016 | Shubs, Jr. | B61C 15/107 |
| 2002/0109017 | A1 * | 8/2002 | Rogers | B05B 3/00 239/227 |
| 2003/0197386 | A1 | 10/2003 | Dalrymple | |
| 2004/0070265 | A1 | 4/2004 | Sakai et al. | |
| 2004/0262425 | A1 | 12/2004 | Sakai et al. | |
| 2006/0005739 | A1 | 1/2006 | Kumar | |
| 2008/0252082 | A1 | 10/2008 | Bartling | |
| 2009/0032350 | A1 | 2/2009 | Shapery | |
| 2010/0070117 | A1 | 3/2010 | Siffert | |
| 2011/0050796 | A1 * | 3/2011 | Nishida | B41J 2/16526 347/29 |
| 2011/0099413 | A1 | 4/2011 | Cooper et al. | |
| 2011/0308765 | A1 | 12/2011 | Kumar et al. | |
| 2012/0061367 | A1 * | 3/2012 | Wolff | B61C 15/107 219/202 |
| 2012/0158223 | A1 | 6/2012 | Liberatore et al. | |
| 2013/0206862 | A1 * | 8/2013 | Worden | B61C 15/107 239/99 |
| 2014/0032083 | A1 | 1/2014 | Kerns et al. | |
| 2014/0033752 | A1 | 2/2014 | Gunjima et al. | |
| 2014/0151460 | A1 * | 6/2014 | Noffsinger | B61C 15/10 239/69 |
| 2015/0051760 | A1 | 2/2015 | Worden | |
| 2015/0053109 | A1 | 2/2015 | Bramlett | |
| 2015/0102594 | A1 * | 4/2015 | Blandina | B60B 39/025 280/855 |

FOREIGN PATENT DOCUMENTS

| | | | |
|---|---|---|---|
| CN | 101119880 | A | 2/2008 |
| CN | 201283865 | Y | 8/2009 |
| DE | 1195793 | B | 7/1965 |
| DE | 19640559 | A1 | 4/1998 |
| DE | 102005001404 | A1 | 7/2006 |
| DE | 102007044367 | A1 | 3/2009 |
| EP | 0499199 | A2 | 8/1992 |
| FR | 2 966 716 | B1 | 12/2012 |
| WO | 2006000093 | A1 | 1/2006 |
| WO | 2006062056 | A1 | 6/2006 |
| WO | 2006088880 | A1 | 8/2006 |

OTHER PUBLICATIONS

PCT Search Report and Written Opinion issued in connection with Related PCT Application No. PCT/US2011/042943 dated Mar. 6, 2012.

Australian Office Action issued in connection with Related AU Application No. 2011289809 dated Jun. 24, 2014.

Chinese Office Action issued in connection with Related CN Application No. 201180039129.8 dated Sep. 3, 2014.

Eurasian Office Action issued in connection with Related EA Application No. 201390047 dated Oct. 31, 2014.

U.S. Non-Final Office Action issued in connection with Related U.S. Appl. No. 13/816,036 dated Jan. 29, 2015.

Unofficial English Translation of Chinese Office Action issued in connection with Related CN Application No. 201180039129.8 dated Apr. 27, 2015.

Australian Notice of Allowance issued in connection with Related AU Application No. 2011289809 dated Oct. 19, 2015.

U.S. Final Office Action issued in connection with Related U.S. Appl. No. 13/816,036 dated Sep. 18, 2015.

Eurasian Office Action issued in connection with Related EA Application No. 201390047 dated Dec. 15, 2015.

U.S. Non-Final Office Action issued in connection with Related U.S. Appl. No. 14/461,092 dated Jan. 14, 2016.

PCT Search Report and Written Opinion issued in connection with Corresponding PCT Application No. PCT/US2016/058483 dated Feb. 1, 2017.

Bret Dwayne Worden et al., Aug. 15, 2014, U.S. Appl. No. 14/460,502.

Bret Dwayne Worden et al., Aug. 15, 2014, U.S. Appl. No. 14/461,092.

Bret Dwayne Worden et al., Feb. 8, 2013, U.S. Appl. No. 13/816,036.

* cited by examiner

SYSTEMS AND METHOD FOR A TRACTION SYSTEM

CROSS-REFERENCE TO RELATED APPLICATIONS

The present application claims priority to U.S. Provisional Application No. 62/245,586, filed Oct. 23, 2015. This application is also a continuation-in-part of U.S. application Ser. No. 14/460,502, filed Aug. 15, 2014, which claims priority to U.S. Provisional Application No. 61/866,248, filed Aug. 15, 2013. The entire contents of the above-referenced applications are hereby incorporated by reference for all purposes.

BACKGROUND

Technical Field

Embodiments of the subject matter disclosed herein relate to tractive effort for a plurality of wheels of a vehicle, for example.

Discussion of Art

Rail vehicles, such as locomotives, have a plurality of wheels configured to move along a rail, or track. Rail vehicles may pull large loads, such as multiple loaded rail cars, over long lengths of tracks. To operate efficiently, the rail vehicle is typically operated with a maximum of tractive effort. However, tractive effort is limited by the amount of contact friction between the wheels of the rail vehicle and the patch of rail over which the wheels are passing at any given moment. This amount of friction, in turn, depends such factors as the presence of contaminants (snow or ice, oil, mud, soil, etc.) on the rail or wheel, the shape (roundness) of the wheel, the shape of the rail, atmospheric temperature, humidity, and the normal force or weight imposed on an axle, among others.

BRIEF DESCRIPTION

In an embodiment, a traction system for a vehicle includes a nozzle coupled to an air source and configured to be selectively aimed toward a determined portion of a rail surface of a rail, and the determined portion is based on a location of the rail surface between edges of the rail and proximate to a wheel of the vehicle. The traction system further includes a conduit configured to supply pressurized air from the air source to the nozzle, the nozzle flexibly coupled thereto. The nozzle is configured for the aim of the nozzle to be controlled to change its aiming direction in response to a change in curvature of the rail, whereby a stream of air from the nozzle impacts the determined portion during movement of the vehicle through the curvature of the rail.

In an embodiment, a control system, e.g., a system for controlling a consist of rail vehicles or other vehicles, includes a control unit electrically coupled to a first rail vehicle in the consist. The control unit has a processor and is configured to receive signals representing a respective presence and position of one or more tractive effort systems on-board the first vehicle and other rail vehicles in the consist. The system further includes a set of instructions stored in a non-transient medium accessible by the processor. The instructions are configured to control the processor to create a schedule (e.g., an optimization schedule) that manages the use of the one or more tractive effort systems based on the presence and position of the tractive effort systems within the consist.

In an embodiment, a method for controlling a consist of at least first and second rail vehicles or other vehicles includes the steps of determining a configuration of tractive effort systems within the consist and enabling the tractive effort systems in dependence upon the determined configuration to increase tractive effort.

In an embodiment, a method for controlling a flow of air to a tractive effort system of a rail vehicle or other vehicle includes the steps of providing a supply of pressurized air from a reservoir to the tractive effort system, and varying the flow of air to the tractive effort system to maintain a pressure in the reservoir above a predetermined lower threshold.

In an embodiment, a system for control of a rail vehicle or other vehicle includes a tractive effort device having a nozzle positioned to direct a flow of air to a rail, a reservoir fluidly coupled to the tractive effort device for providing a supply of compressed air to the tractive effort device, and a control unit electrically coupled to the tractive effort device and configured to control a flow of compressed air from the reservoir to the tractive effort device in dependence upon an available pressure within the reservoir.

In an embodiment, a system (for use with a vehicle having a wheel that travels on a surface, e.g., a rail vehicle having a wheel that travels on a rail) includes a tractive effort system including an air source for supplying compressed air and a nozzle fluidly coupled to the air source and configured to direct a flow of compressed air from the air source to a contact surface of the rail, and a control unit electrically coupled to the tractive effort system and configured to control the tractive effort system between an enabled state, in which compressed air flows from the air source and out of the nozzle of the tractive effort system, and a disabled state, in which compressed air is prevented from exiting the nozzle. The control unit is further configured to control the tractive effort system from the enabled state to the disabled state in dependence upon the presence of at least one adverse condition.

In an embodiment, a method for controlling a rail vehicle or other vehicle includes providing a tractive effort system having a nozzle for directing the flow of compressed air to the contact surface of a rail and disabling the tractive effort system when an adverse condition is detected.

In an embodiment, a system (for use with a vehicle having a wheel that travels on a surface, e.g., a rail vehicle having a wheel that travels on a rail) includes an air source for supplying compressed air, a nozzle fluidly coupled to the air source and configured to direct a flow of compressed air from the air source to a contact surface of the rail, and a valve positioned intermediate the air source and the nozzle. The valve is controllable between a first state in which the compressed air flows from the air source to the nozzle, and a second, disabled state in which the compressed air is prevented from flowing to the nozzle. The system further includes a controller for controlling the valve between the first state and the second, disabled state, and an operator interface electrically coupled to the controller. The operator interface includes a momentary disable switch biased to a position that controls the valve to the first state and movable against the bias to control the valve to the second, disabled state.

In an embodiment, a system (for controlling a consist of vehicles having a plurality of wheels that travel on a surface, e.g., a consist of rail vehicles having a plurality of wheels that travel on a rail) includes a tractive effort system on-board a first rail vehicle. The tractive effort system includes a media reservoir capable of holding a tractive material, a tractive material nozzle in communication with the media reservoir and configured to direct a flow of tractive material to a contact surface of the rail, a compressed air reservoir, and a compressed air nozzle in communication with the compressed air reservoir and configured to direct a flow of compressed air to the contact surface of the rail. The system further includes a control unit electrically coupled to a first rail vehicle in the consist, the control unit having a processor and being configured to receive signals indicative of slippage, individual axle tractive effort, overall rail vehicle tractive effort and horsepower. The control unit is further configured to control the tractive effort system to apply compressed air only to the contact surface of the rail and monitor at least one of slippage, individual axle tractive effort, overall rail vehicle tractive effort and horsepower after application of the compressed air only.

In an embodiment, a method for controlling a rail vehicle or other vehicle having a tractive effort system includes the steps of enabling the tractive effort system to apply a blast of air only to the rail, monitoring one of slip, individual axle tractive effort, overall tractive effort and horsepower, and enabling the tractive effort system to apply tractive material to the rail in dependence upon at least one parameter.

DETAILED DESCRIPTION

Embodiments are disclosed herein that relate to a traction system for a vehicle, where the traction system modifies the traction of a wheel contacting a surface. In one example, the vehicle may be a rail vehicle, such as a locomotive, and the surface may be a surface of a rail. In another example, the vehicle may be an on-road vehicle such as an automobile, and the surface may be a surface of a road. The traction system may include a nozzle coupled to an air source. The air source may be a compressed air tank or other suitable supply of pressurized or compressed air. The nozzle may be configured to be selectively aimed toward a determined portion of the surface. The determined portion may be a location of the surface between edges of the surface (e.g., between an inner surface and an outer surface of a rail) and proximate to a wheel of the vehicle. The traction system further includes a flexible coupling (e.g., a conduit) between the nozzle and the air source, such as a pipe, tube, or hose. The nozzle is controlled to change its aiming direction in response to a change in curvature of the surface, and a stream of air form the nozzle impacts the determined portion of the surface during movement of the vehicle through the curvature of the surface.

In this way, the traction system may provide a stream of air that impacts the surface on which the vehicle is traveling at a determined location of the surface during vehicle movement. The stream of air may be at sufficient velocity to dislodge water, ice, or other debris from the surface to increase traction. The traction system includes a moveable nozzle that may be actuated to change its aiming direction to maintain the impact of the air stream on the determined location when the vehicle is traveling over a curved portion of the surface. As used herein, the terms "air stream" and "stream of air" may refer to a supply of air from the traction system to a surface that only includes air and does not include any additional added constituents such as sand or other abrasives. However, in some examples, the tractions system may include a separate sander to supply abrasives to the surface, while in other examples abrasives may be supplied along with the air stream.

The approach described herein may be employed in a variety of mobile platforms, such as engine-driven vehicles, electrically-driven vehicles, or vehicles propelled according to another suitable mechanism. Such vehicles can include on-road transportation vehicles, as well as mining equipment, marine vessels, rail vehicles, and other off-highway vehicles (OHV). For clarity of illustration, a locomotive is provided as an example of a self-propelled rail vehicle, and more broadly, as an example of a mobile platform, supporting a system incorporating an embodiment of the invention.

Figure 1A:
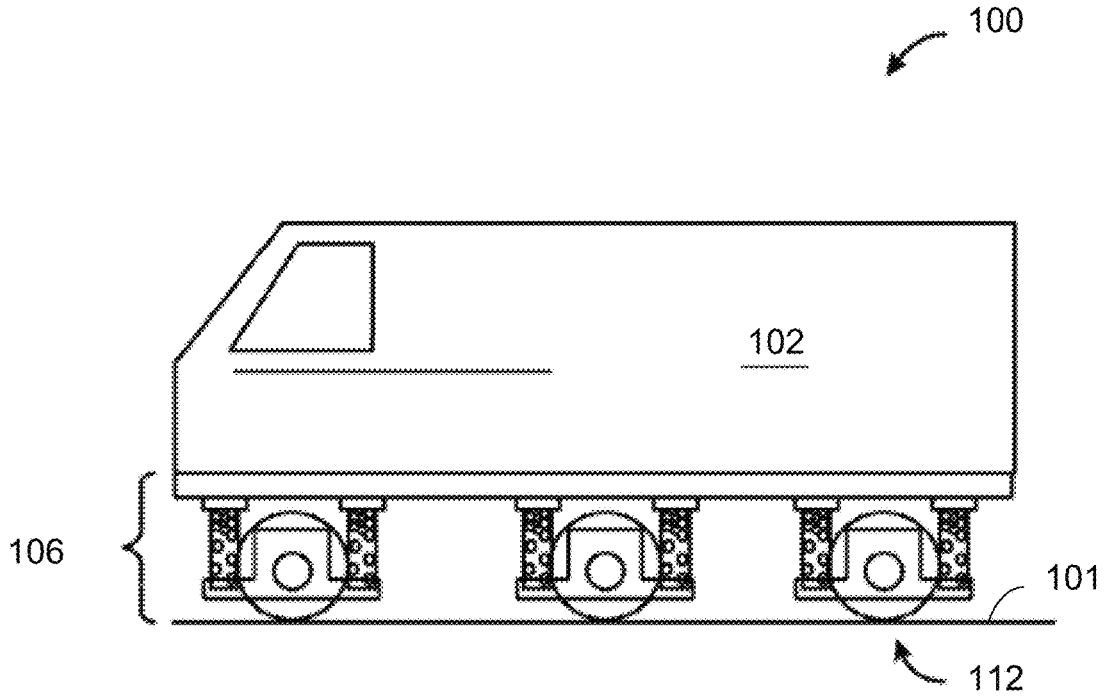
FIG. 1A shows a schematic diagram of a rail vehicle with three motor combos according to an embodiment of the invention.

FIG. 1A is a block diagram of a locomotive or other rail vehicle 100 according to an embodiment of the invention. The locomotive or other rail vehicle 100 shown in FIG. 1A comprises a superstructure 102 and a rail vehicle truck 106. The superstructure 102 may be the body of the locomotive or other rail vehicle 100. The rail vehicle truck 106 may include a frame and motor combos 112 mounted thereto that transport the locomotive or other rail vehicle 100 along rails 101. As shown, the rail vehicle includes three motor combos.

The rail vehicle 100 may include an engine (not shown), such as an internal combustion engine, which may be mechanically coupled to an alternator. For example, the engine may be a diesel engine that generates a torque output that is transmitted to the alternator. The alternator produces electrical power that may be stored and applied for subsequent propagation to a variety of downstream electrical components. As an example, the alternator may be electrically coupled to a plurality of traction motors (described below) and may provide electrical power to the plurality of traction motors. In some examples, the plurality of traction motors may be powered by an alternate source, such as via an on-board battery or fuel cell, overhead electric wires, etc.

Figure 1B:
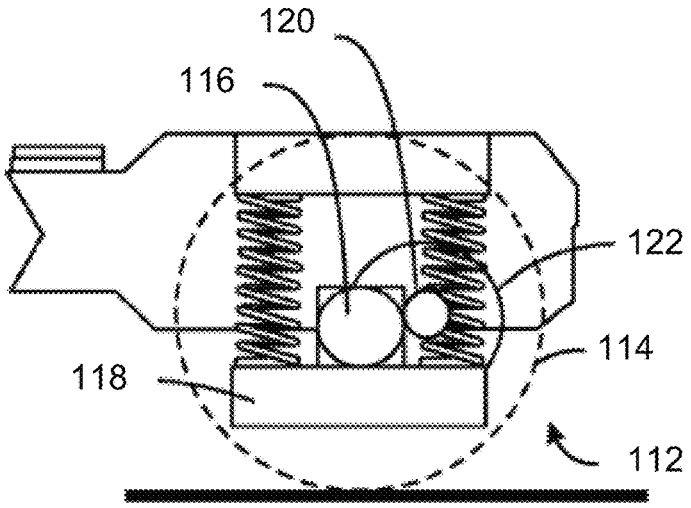
FIG. 1B shows a schematic diagram of one motor combo of FIG. 1A.

FIG. 1B is a schematic diagram of a motor combo according to an embodiment of the invention. Each motor combo 112 typically includes two train wheels 114, an axle 116 connecting the wheels 114, two journal bearing housings 118, a bull gear 120, and a traction motor 122. The journal bearing housing 118 contains a roller bearing for the axle. In a more general sense, each motor combo 112 is a device or assembly (disposed or to be disposed in a rail vehicle truck) that includes a traction motor 122 and some or all of the equipment (e.g., axle 116, wheels 114) used for interfacing the motor 122 with the rails on which the vehicle travels, for moving the vehicle along the rails.

As described above, the tractive effort of the plurality of wheels is dependent on the amount of friction that is generated between each wheel and the patch of rail with which the wheel is in contact. Various factors may affect the amount of friction generated, including contaminates present on the rail. In particular, adverse weather conditions may result in snow, ice, and/or water being present on the rail. Because these conditions may appear suddenly, and are particularly prone to occurring in mountainous regions where haulage ability is already limited by steep grades, rail vehicle operators may choose to avoid mountainous routes and/or limit the tonnage of the load being pulled, to avoid loss of traction.

One approach for improving adhesion between the wheels and the rail during conditions of wheel slip/loss of tractive effort includes removing contaminates from the rail prior to the wheels contacting the rail. To achieve this, rail vehicles may be equipped with a rail cleaning system including a pipe having a nozzle pointed at the location of the rail where the wheel contacts the rail, just in front of the lead wheels of the rail vehicle. The nozzle may direct high-pressure air onto the rail, clearing the rail of snow, water, dirt, or other debris, thus increasing the friction between the rail and wheels. The rail cleaning system may direct the air to the rail upon request from an operator, or automatically in response to detection of wheel slip, for example.

While such a system may efficiently remove contaminates from the rail and increase tractive effort of the vehicle, it may encounter difficulty when the rail vehicle is traversing a curve, if the cleaning system nozzle has a fixed position relative to the rail vehicle. When the rail vehicle traverses a curve, the wheels may move laterally. For example, the wheels may be configured to contact the rail on the center of the rail while traveling on a straight rail, and then shift to the left of the rail as the rail curves to the right and the wheels continue to move in a straight path. Further, the rail ahead of the wheels has a curvature that the vehicle is following, but the body of the vehicle may remain substantially tangent to this curve at any given point in time. As a result, the nozzle may not point to the rail and may instead direct air to the side of the rail. Not only does this result in contaminates not being removed from the rail, but it also can cause snow, dirt, or other debris to blow onto the rail, further reducing the friction and tractive effort.

When the nozzle is rigidly mounted, the air flow is directed away from the desired target area while the rail vehicle traverses a curve. The high rail airflow shifts towards the outside of rail while the low rail airflow shifts toward the inside of the rail. This is due to 1) the lateral shift of the wheel set, 2) the attack angle between the wheel and the rail, 3) any wheel flange wear (and rail wear), and 4) any track gauge widening (though this effect is only experienced at the low rail).

Figure 2:
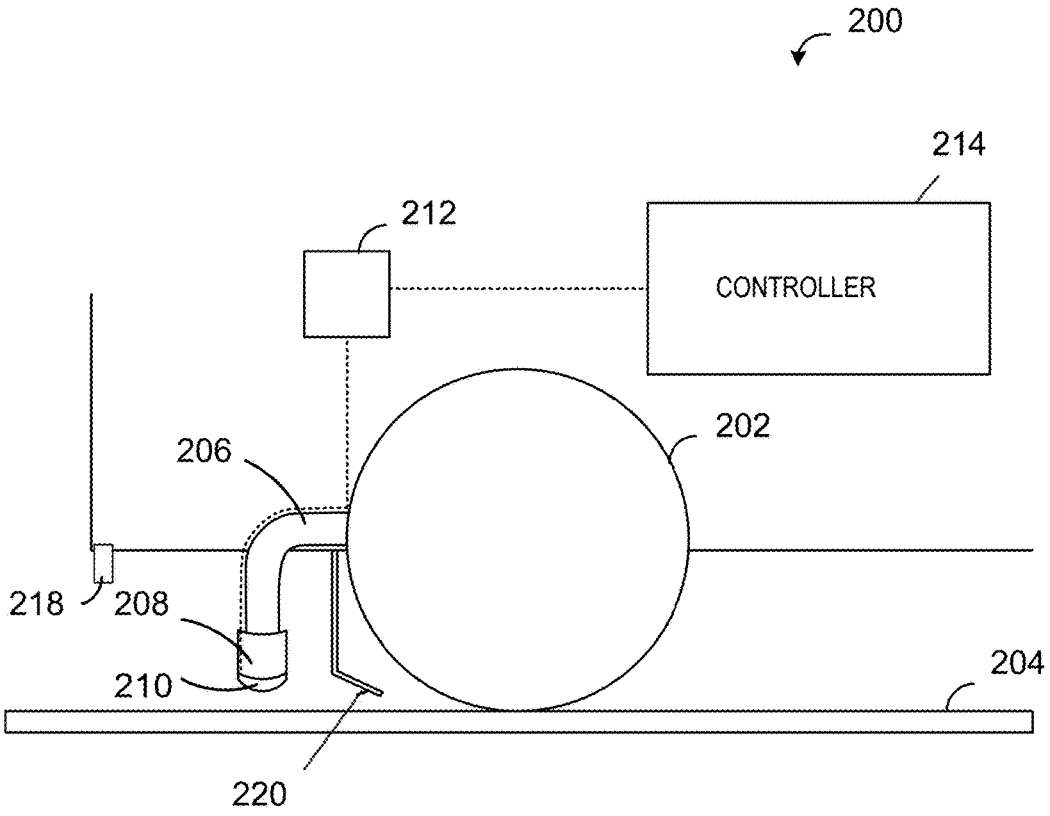
FIG. 2-6 schematically illustrate embodiments of a traction system having a resiliently-mounted nozzle.

Thus, according to embodiments disclosed herein, a traction system may be configured so that a nozzle may follow a surface on which vehicle is traveling as the vehicle traverses a curve. In one example illustrated in FIG. 2, a traction system 200 may include a resiliently-mounted nozzle. The traction system 200 includes a nozzle 208 coupled to an air source via a passage 206 (e.g., a conduit such as a pipe, hose, tube, or other conduit). The passage may be coupled to a suitable structure of the vehicle, such as to a support structure of a lead axle of the vehicle (e.g., to a journal bearing housing, such as journal bearing housing 118 of FIG. 1B).

As explained above, the nozzle directs the air onto a surface 204 ahead of a wheel 202 of a lead axle. In one example, the surface may be a surface of a rail (also referred to as a track). In such examples, the nozzle is configured to be selectively aimed toward a determined portion of a rail surface. In one example, the determined portion of the rail surface may be a location of the rail surface between the edges of the rail and proximate to the wheel. The determined portion includes a region of the rail surface where the air stream impacts the rail surface. The determined portion may comprise a suitable region of the rail surface, such as near an inner edge of the rail surface, near an outer edge of the rail surface, or in the center of the rail surface. In some examples, the determined portion may be a fixed region, while in other examples the determined portion may change depending on rail curvature (e.g., when on a straight section of the rail, the determined portion may be near an outer edge of the rail surface, while when on a curved section of the rail, the determined portion may be in a center of the rail surface. The determined portion/impact area may be a given distance from the wheel (e.g., 5 cm, 10 cm, half a meter, or other suitable distance). The nozzle may be angled away from the wheel in one example. In some examples, the nozzle may be angled inward towards the vehicle or angled outward away from the vehicle.

In other examples, the surface may be a road, and the nozzle may be configured to be selectively aimed toward a determined portion of the road surface. The determined portion of the road surface may be a location of the road surface between edges of the road and proximate the wheel, and may have similar characteristics as the determined portion of the rail surface described above (e.g., located in front of the wheel by a certain distance, in the center and/or near an edge of the road surface, etc.).

The passage is configured to supply pressurized air from the air source to the nozzle. The passage may be flexible (e.g., comprised of rubber or other flexible material) so that the nozzle can follow the surface as the wheels shift relative to the surface and/or the vehicle traverses a curve. Further, the nozzle may be flexibly coupled to the passage.

The air source may include compressed air, such as from a compressed air tank of the vehicle, from downstream of intake air compressor of an engine, or other suitable source of compressed air. The air source may supply compressed air at a rate of 2.5-5.5 standard cubic meters per minute and/or at a pressure of 90-150 psi (620-1030 kPa). The nozzle may supply the stream of air to the surface at a pressure of 90-150 psi (620-1030 kPa) and/or at an impact velocity of greater than 23 meters per second. In one example, the air source, passage, and nozzle may be configured to provide a suitable pressure ratio at the nozzle, in order to supply the air stream at a desired velocity. For example, the nozzle may be a convergent-divergent nozzle, and the air source, passage, and nozzle may be configured to provide a pressure ratio that will result in sonic or supersonic air stream velocity at the nozzle exit, such as at a pressure ratio of 1.89 or greater. In one example, the system may generate pressurized air at greater than the sonic pressure ratio relative to ambient pressure to provide choked flow through the nozzle, with only air flowing through the nozzle and without any sand through the nozzle and without any sand carried by the airflow passing through and exiting the nozzle en route to the rail.

The nozzle may include an actuator 210 or other structure that may change the aiming direction of the nozzle, in response to a change in a curvature of the surface, for example. In this way, a stream of air from the nozzle may impact the determined portion of the surface during movement of the vehicle in which the traction system is mounted through the curvature of the surface.

The actuator may be a suitable actuator that forces the aiming direction of the nozzle in response to the change in curvature. In one example, the actuator is an electromagnet. The electromagnet may be positioned in a suitable location on the nozzle, for example the electromagnet may be annular and surround the opening of the nozzle, or may be positioned in another suitable location. The electromagnet may be energized from a voltage source 212 responsive to a signal from an electronic controller 214, for example. Once energized, the electromagnet may remain in a fixed position relative to the surface due to the attraction between the magnet and the steel (or other metal) material of the surface (e.g., the rail). Because the passage is made from flexible material (e.g., rubber), the nozzle is then able to move relative to the truck frame and wheels. The electronic controller may include non-transitory instructions stored in memory that when executed cause the controller to send a signal to activate the electromagnet, e.g., the controller may activate a switch coupled between the voltage source and the electromagnet. The instructions may include instructions to activate the electromagnet when a curve is detected, when wheel slip is detected, responsive to a user request, and/or other suitable parameters.

In some examples, the traction system 200 may include one or more sensors 218 for detecting the curvature of the surface. The one or more sensors may include optical sensor(s), magnetic sensor(s), or other suitable sensors that may determine surface curvature by sensing the shape of the surface itself, or by sensing relative movement between vehicle components that may shift as the vehicle traverses a curved portion of the surface. For example, the one or more sensors may detect linear motion between a truck and an axle/axle mounted components of the vehicle. In another example, the one or more sensors may sense the angular motion between the truck and a car body of the vehicle.

The output from the one or more sensors may be sent to the controller, and the controller may determine the aiming direction of the nozzle based on the sensor output. For example, the sensor output may be used by the controller to determine a curvature of the surface, and the controller may include a look-up table that maps nozzle aiming direction to surface curvature. The controller may obtain the aiming direction by inputting the surface curvature into the look-up table. The aiming direction may include an amount of displacement from a default position of the nozzle (e.g., in length, degrees, or other suitable measurement).

The controller may then send a command to the actuator to activate the actuator to control the nozzle aiming direction to the determined aiming direction. In one example, the nozzle may have a default position where the nozzle is centered over or otherwise aiming toward the determined portion of the surface, when the surface is straight. Once the vehicle begins, or is about to begin, traversing a curve of the surface, the nozzle may be controlled to change its aiming direction so that it continues to supply air to the determined location of the surface. After the vehicle has traversed the surface, the nozzle may be controlled to return back to the default position, e.g., by ceasing activation/energizing of the actuator.

As explained above, the actuator may include an electromagnet. In one example, the amount of energy supplied to the electromagnet may be based on the determined aiming direction. In another example, the electromagnet may include a plurality of electromagnets distributed around the nozzle, for example. In such cases, which electromagnets are energized may be based on the aiming direction. For example, if the aiming direction is to the right of the default position, one or more electromagnets on the right side of the nozzle may be energized, while if the aiming direction is to the left of the default position, one or more electromagnets on the left side of the nozzle may be energized.

In another example, the actuator may be a stepper motor or other type of motor that moves the nozzle responsive to a command from the controller. In such an example, an amount of energy supplied to the motor may be based on the aiming direction, for example the controller may determine a duty cycle of the motor based on the aiming direction and operate the motor at the determined duty cycle.

The nozzle of the traction system may be positioned and controlled to be aimed away from the wheel in order to ensure the debris is cleared from the surface before the wheel contacts that portion of the surface. Additionally, by pointing the nozzle away from the wheel rather than toward the wheel, space may be made available to then apply abrasive to the surface, without the high-velocity stream of air dislodging the abrasive. For example, a sander 220 may be present to supply sand or other abrasives toward the wheel. The sander may point toward the wheel, while in some examples the nozzle that supplies air may point away from the wheel. The sander may not be configured to change aiming direction, as the sander may spray abrasive in a broad arc that impacts the surface even when the surface is curved. Further, the sander may spray sand (and any air used to force the sand out of the sander) at a relatively low velocity, such as less than 23 meters per second and/or at a pressure less than 90 psi (620 kPa).

An additional or alternative mechanism to adjust the aiming direction of the nozzle includes transferring relative motion between the vehicle frame and wheel set to the nozzle and/or associated passage. Such a mechanism is described below with respect to FIGS. 3-6. While FIGS. 3-6 are described with respect to a vehicle traversing a rail (such as a locomotive), it is to be understood that a similar mechanism may be employed for other vehicle types and/or on other surfaces.

As described above, the wheels of the vehicle are configured to move laterally with respect to the frame of the vehicle as the vehicle traverses a corner. This lateral displacement may be utilized to adjust the position of the nozzle and associated passage so that the nozzle maintains a fixed position relative to the surface, even as the surface curves. This mechanism utilizes the inherent relative lateral motion between the wheel set and the truck frame to deflect the initial orientation of the nozzle through the use of a resilient mount on the wheel set and hard-mounted lever bracket on the truck frame. The wheels are fixed to the axle, but the axle can shift laterally relative to the truck frame. Lateral play is provided between journal bearing housing and truck frame.

Three axle trucks utilize lateral axle clearance to help negotiate tight curves. Normally the clearance between the wheel set and the rail, sometimes called flange clearance, allows the truck with a relatively long wheelbase to negotiate through the curve. Additionally, some rail vehicles may have tapered wheels and this flange clearance also allows the tapered wheel to move laterally and thus change its rolling radius, in order to reduce sliding. As the curvature becomes more severe, this wheel flange clearance is used up and lateral forces between the track and wheels increase. To alleviate this, the axles of the truck are allowed move in a lateral direction, relative to the truck frame and each other.

This motion may be utilized to maintain the nozzle of the traction system over the rail. As the truck enters any curve, the wheel set is forced to follow the rail while the truck frame continues on a tangent path (as shown in FIG. 4). This creates relative lateral motion between the truck and the wheel set. This motion is controlled by the amount of the designed clearance between the truck frame and the wheel set. The nozzle is resiliently mounted on the journal bearing housing which is mounted on the end of the axle and follows the position of the wheel. Another bracket is mounted on the truck frame and acts as a lever which deflects the journal bearing housing mounted nozzle, as illustrated schematically in FIGS. 3-6 and described in more detail below.

Figure 3:
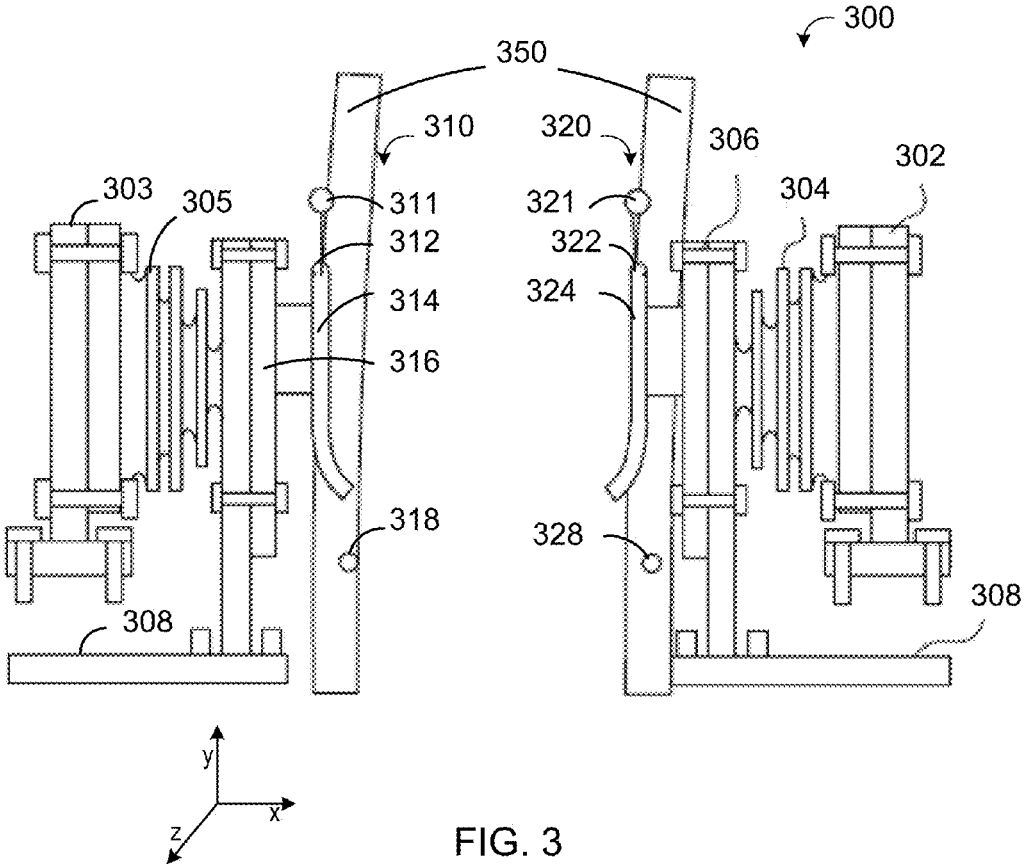
Figure 4:
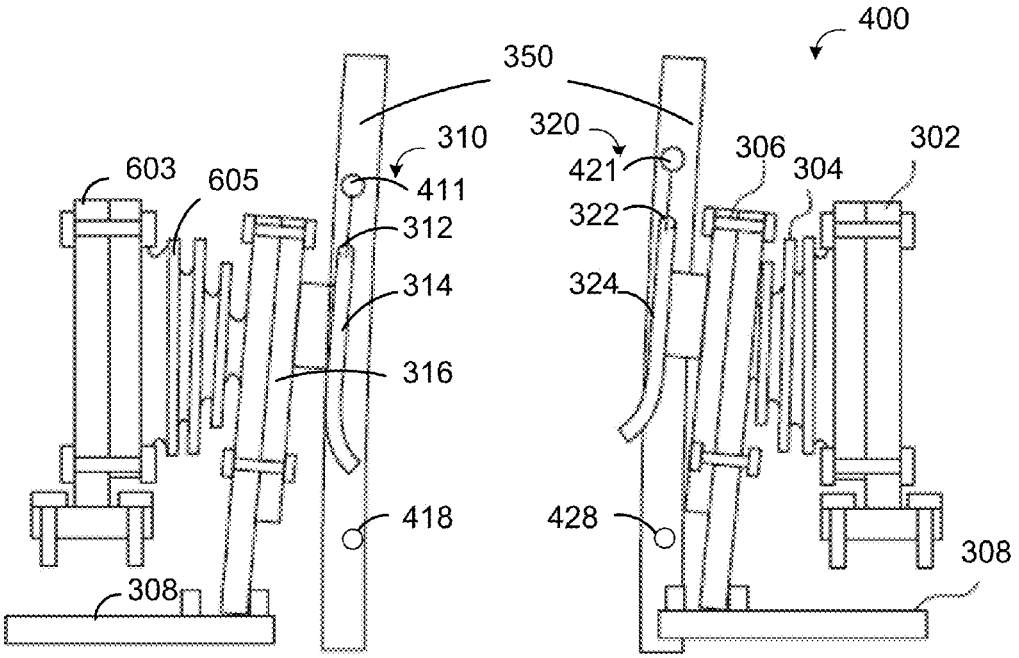

FIG. 3 schematically shows a first view 300 of the mechanical coupling between the nozzle and flexibly-coupled passage (e.g., the pipe, tube, or hose) and a support of a lead axle of the vehicle (e.g., a journal bearing housing) via a lever bracket. A set of rails 350 is illustrated with a wheel set coupled to an axle, which is in turn coupled to two respective journal bearing housings (also referred to as J-boxes).

A traction/rail cleaning system is schematically shown for each wheel/rail, including a first traction system 310 and a second traction system 320. Each of the first traction system 310 and second traction system 320 may be non-limiting examples of the traction system 200 described above with respect to FIG. 2. As such, each traction system includes a nozzle coupled to a pipe that is mounted to a respective journal bearing housing. Thus, as shown, the first traction system 310 includes a nozzle 312 coupled to a pipe 314 mounted to a lever bracket 316. The second traction system 320 includes a nozzle 322 coupled to a pipe 324 mounted to a lever bracket 306. The wheel/rail contact point for each wheel, which only comprises a portion of the respective rail (e.g., $1/6^{th}$ of the width of the rail), is shown schematically at 318 and 328, while the impact point (the position on the rail where the nozzle of the traction system directs the pressurized air) for each traction system is schematically shown at 311 and 321. As illustrated, each impact point is located in front of, and spaced apart by a threshold distance, the respective wheel/rail contact point. Because of the separation between the impact point and the wheel contact location, curvature of the rail may result in the target impact point changing its position relative to the wheel contact point, compared to when the rail is straight. For example, the target impact point and wheel contact location may be aligned along a straight line that is parallel to the longitudinal axis of the rail when the rail is straight. When the rail is curved, the target impact point (e.g., the center of the rail surface) may be aligned with the wheel contact location along a diagonal line.

Each journal bearing housing is mounted to a lever bracket via a set of bellows or other resilient member (e.g., spring). Each lever bracket is coupled to the truck frame. For example, as shown in FIG. 3, the second traction system is mounted to a lever bracket 306 that is mounted to the truck frame 308 (e.g., a frame of the truck 106 of FIG. 1A). The lever bracket 306 is coupled to the journal bearing housing 302 (e.g., journal bearing housing 118 of FIG. 1B) via a bellows 304. Likewise, the first traction system is mounted to lever bracket 316, which is mounted to the truck frame 308. The lever bracket 316 is mounted to the journal bearing housing 303 via a bellows 305.

The frame may include lips or tabs on each side of the lever bracket that define a flange clearance of the lever bracket. Once the flange clearance is used up, the leftward lateral movement of the truck frame shifts the bottom end of the lever bracket to the left, causing the top end of the lever bracket to shift to the right, as shown in FIG. 4. The lever bracket is now angled by an amount that is based on the lateral movement of the truck frame. As a result, the nozzle is shifted to the right and the impact point is on the rail, even though the rail is curving to the right. Accordingly, as shown by a second view 400 of FIG. 4, the wheel/rail contact points 418 and 428 remain in substantially the same relative lateral location (e.g., relative to the edges of the rail) and the impact points 411 and 421 stay centered over the respective rails.

As described above, the frame of the vehicle may move laterally during traversal of a curve, and this relative motion may be transferred to the nozzle to change the aiming direction of the nozzle in a lateral direction (e.g., left to right). However, the frame of the vehicle may also move vertically and mechanisms may be included to translate the vertical motion to the nozzle, for example to maintain the nozzle at a fixed distance above the rail surface. For example, the frame 308 may include a lip that protrudes out along a bottom of the frame that is configured to engage the lever bracket (e.g., 306) if vertical movement of the frame exceeds a threshold. Additionally or alternatively, the traction systems described above with respect to FIGS. 2-4 may include hydraulics and/or other pressurized lines to move the respective nozzles based on the curvature of the surface.

Figure 5:
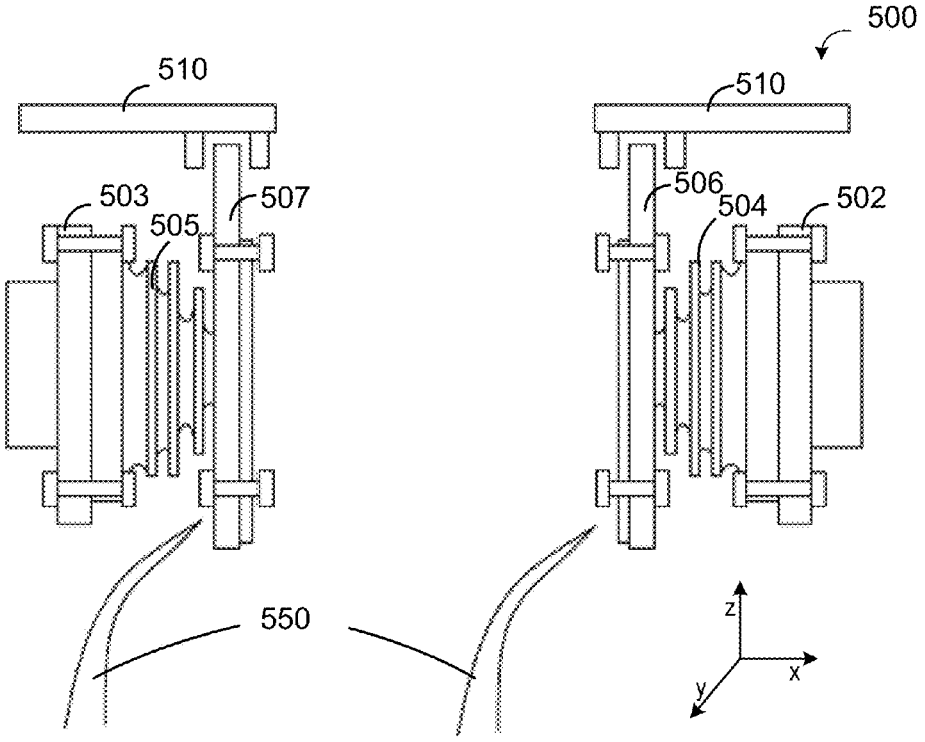
Figure 6:
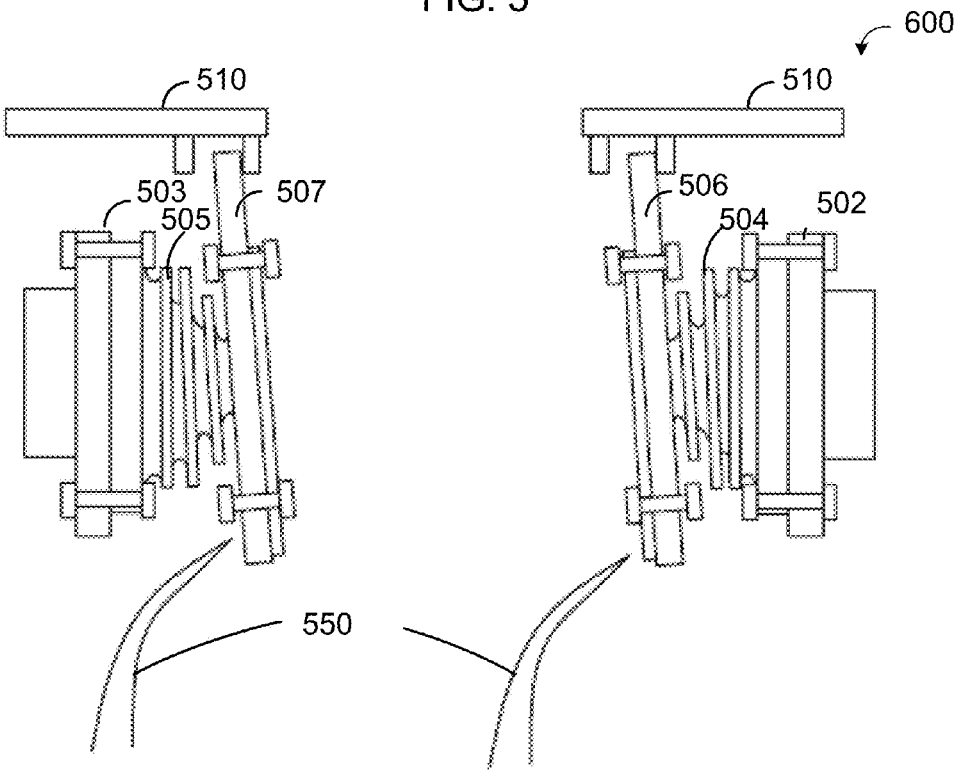

The example illustrated in FIGS. 3 and 4 is a top-down view where the lever bracket extends horizontally (e.g., the lever bracket has a longitudinal axis that is parallel to the rails when the lever bracket is not moved by the truck frame). For example, FIG. 3 includes a Cartesian coordinate system, and the lever bracket has a longitudinal axis parallel to the y-axis, as do the rails. The truck frame has a longitudinal axis parallel to the x-axis. However, in other examples, the lever bracket may extend vertically, having a longitudinal axis that is perpendicular to the rails. An example of this configuration is illustrated in FIGS. 5-6, which show side views 500 and 600, respectively, of the journal bearing housings and lever brackets relative to a set of rails 550. Herein, each respective lever bracket (506 and 507) is configured to interact with the truck frame 510 at a top side and be shifted laterally as the truck frame moves relative to the axle. As shown, the lever brackets are coupled to the journal bearing housings 502 and 503 via respective bellows 504 and 505.

FIG. 5 also includes a Cartesian coordinate system. As the views 500 and 600 are side views and not top-down views, the coordinate system is shifted so that the rails remain parallel to the y-axis. The lever brackets 506 and 507 have a longitudinal axis that is parallel to the z-axis, and thus is orthogonal (e.g., perpendicular) to the longitudinal axis of the rails.

The nozzle (not shown in FIGS. 5-6) may be coupled to the bottom end of the lever bracket and hence when the top end of the lever is shifted to the left in FIG. 6 as the rail curves to the right, the bottom end and hence the nozzle is shifted to the right.

Thus, a traction system configured to clean a surface such as a rail may include a nozzle coupled to a pipe and positioned to direct pressurized air onto a desired location of a surface (e.g., a rail), for example immediately ahead of a subsequent wheel/rail contact point. The nozzle may be configured to track the position of the rail so that the nozzle directs the air to the rail even as the rail curves. In one example, the nozzle may include an electromagnet that is energized responsive to an indication of wheel slip, for example, and a flexible pipe that allows movement of the nozzle as the rail curves. In another example, a mechanical linkage between the truck frame and journal bearing housing may shift the nozzle in a direction opposite the direction of the lateral movement of the truck frame as the rail vehicle traverses a curve, by an amount that depends on the lateral movement of the truck frame relative to the axle. The mechanical linkage may include a lever coupled to the journal bearing housing via a bellows, where lateral motion of the truck frame moves a first end of the lever and causes a second, opposite end of the lever to move in the opposite direction, where the nozzle is coupled to the second end of the lever. In some examples, both the electromagnet and the mechanical linkage may be used together. For example, the mechanical linkage may provide a more coarse adjustment to place the nozzle in the vicinity of the track, while the electromagnet may provide a more fine adjustment to position the nozzle at the exact desired location relative to the track. Further, similar rail-tracking mechanisms could be applied to other adhesion generating systems, such as the sand blower described above.

The mechanical linkage alignment method for the nozzle described above uses relative motion between the axle and the truck frame to deflect the orientation of the nozzle so that it aims more towards the direction of the curvature of the rail while in curves. This alignment may be achieved in either the vertical or horizontal plane, and each direction may have different sensitivity based on the base angles between the rail and the nozzle. The alignment on a tangent (e.g., straight) rail is not compromised, as oscillatory motion of the wheel set predominately occurs at higher speeds where the traction system is not activated nor is high tractive effort utilized. The flexible pipe and/or bellows may be comprised of rubber to accommodate motion to manage part fatigue.

By providing a traction system where the nozzle tracks the rail, the nozzle may be aimed at the rail even when the entire traction system itself is not directly over the rail. In doing so, tractive effort that would normally be lost during curving on steep grades may be maintained. Additionally, the tractive effort for a rail vehicle starting up on flat curves or in locations where the nozzle may be missing the rail may be increased. In this way, the efficiency and adhesion performance of the rail vehicle may be fulfilled throughout an entire trip and not just on straight track, providing the customer with more advantages in defining train set ups and maximizing gross train weight.

Figure 7:
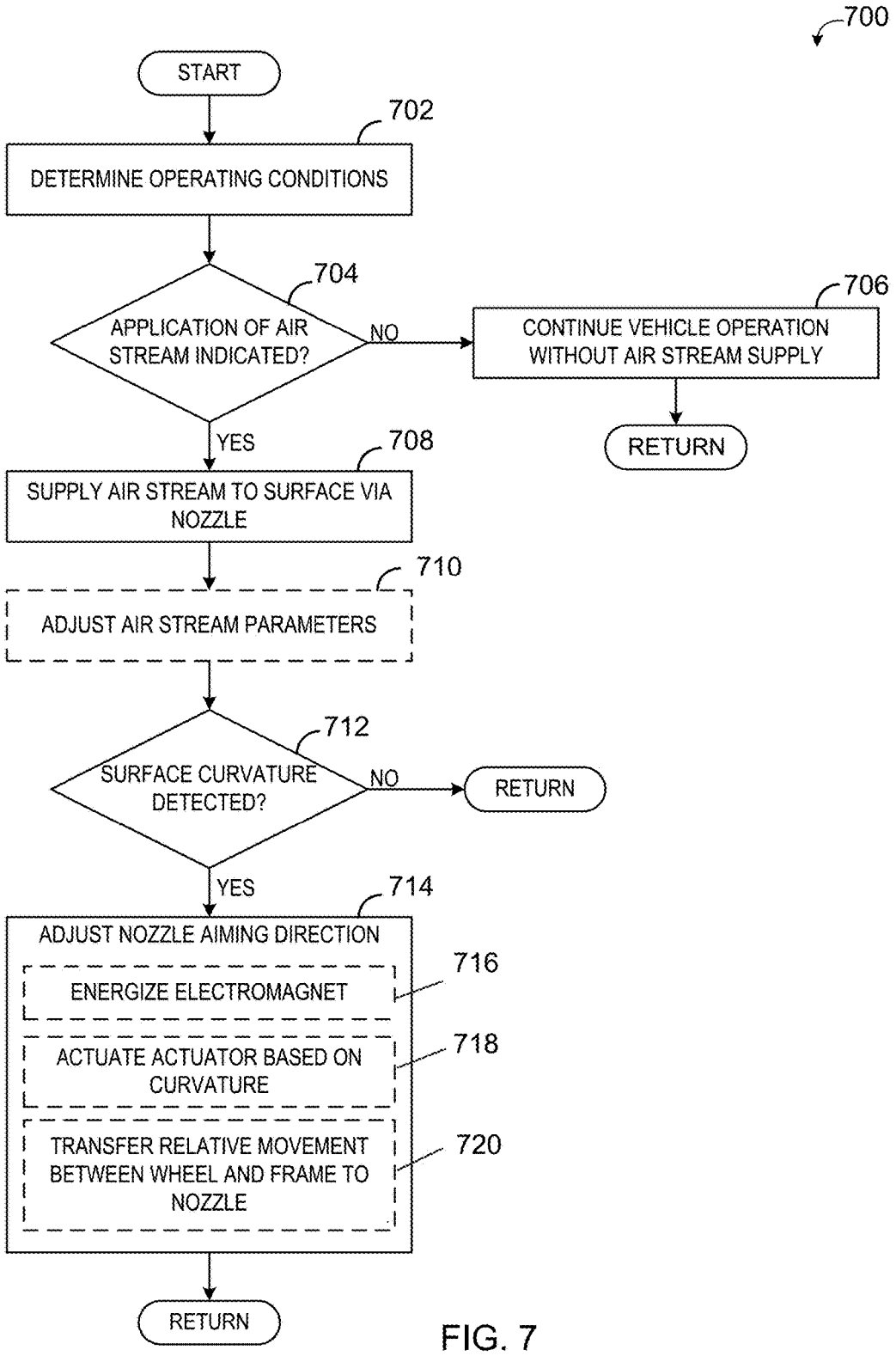
FIG. 7 is a flow chart illustrating a method for operating a traction system according to an embodiment of the invention.

Turning now to FIG. 7, a method 700 for operating a traction system is illustrated. Method 700 may be executed by a controller according to non-transitory instructions stored in memory of the controller, such as controller 214 of FIG. 2, in conjunction with a traction system, such as the traction system 200 of FIG. 2 and/or the tractions systems of FIGS. 3-4 and/or FIGS. 5-6. At 702, method 700 includes determining operating conditions. The determined operating conditions may include vehicle operating conditions such as engine speed, vehicle speed, engine load, wheel slip, tractive effort, and/or other suitable conditions. The determined operating conditions may further include travel surface conditions, such as surface grade, surface curvature, and ambient conditions such as ambient temperature. The determined operating conditions may be determined based on output from on-board sensors (e.g., surface curvature sensors, such as sensor 218 of FIG. 2) and/or from information received from a remote system, such as a dispatch center or GPS unit (e.g., ambient temperature, upcoming surface conditions).

At 704, method 700 determines if application of an air stream from the traction system is indicated. The application of the air stream may include coupling the passage and associated nozzle of the traction system to an air source in order to direct pressurized air to the surface on which the vehicle is traveling. Accordingly, the application of the air stream may be indicated when tractive effort may be limited by surface conditions such as water, ice, or other debris on the surface. In one example, the application of the air stream may be indicated responsive to ambient temperature being below a threshold temperature, responsive to moisture on the surface being above a threshold level (e.g., when it is raining or snowing), and/or responsive to the surface grade being greater than a threshold grade. In another example, application of the air stream may be indicated responsive to wheel slip greater than a threshold slip. In a still further example, even when application of the air stream is indicated based on surface conditions, the application of the air stream may be delayed or ceased if certain conditions are met. For example, the application of the air stream may be ceased or delayed if the vehicle is in a certain location, such as near people or while in a residential neighborhood, as the air stream may produce undesirable noise, and/or the application of the air stream may be ceased or delayed if the vehicle is at idle or if the amount of air in the air source is below a threshold level.

If application of the air stream is not indicated, for example if desired tractive effort is being met, method 700 proceeds to 706 to continue vehicle operation without the air stream supply. This may include blocking a fluidic coupling between the nozzle/passage of the traction system and the air source. Method 700 then returns.

If application of the air stream is indicated, for example if desired tractive effort is not being met due to lowered surface friction, method 700 proceeds to 708 to supply the air stream to the surface via the nozzle of the traction system. This may include establishing a fluidic coupling between the nozzle/passage of the traction system and the air source, such as by opening a valve coupled between the air source and nozzle. Further, the air stream may be applied while the nozzle of the traction system is at a default position. At 710, method 700 optionally includes adjusting one or more air stream parameters. For example, an amount and/or velocity of the supplied air stream may be adjusted based on the magnitude of the wheel slip or the operational mode of the vehicle, such as if the vehicle is on a hill or if the vehicle is trying to stop. For example, in response to a first, smaller amount of wheel slip, the air stream may be supplied at a first, lower velocity, while in response to a second, larger amount of wheel slip, the air stream may be supplied at a second, higher velocity. In another example, the air stream may be supplied at a higher velocity when the vehicle is traveling up a hill relative to when the vehicle is traveling on a level surface.

At 712, method 700 includes determining if surface curvature is detected. The surface curvature may be detected according to output from one or sensors (e.g., the sensor 218 of FIG. 2), the surface curvature may be detected based on information received from a GPS unit or other remote service, and/or the surface curvature may be detected based on relative movement between the vehicle frame and wheels of the vehicle. Further, the surface curvature may be detected once the vehicle actually starts to traverse the curve, or it may be detected in advance of the vehicle traversing the curve.

If no surface curvature is detected, method 700 returns and continues to supply the air stream if indicated, with the nozzle in the default position. If surface curvature is indicated, method 700 proceeds to 714 to adjust the nozzle aiming direction. In one example, as indicated at 716, adjusting the nozzle aiming direction may include energizing an electromagnet of the nozzle. When the vehicle is a rail vehicle such as locomotive, the surface that the vehicle travels on may be made out of metal (e.g., a steel rail), and hence energizing the electromagnet causes the nozzle to be attracted to and follow the rail surface. Thus, when the rail surface is curved, the nozzle will follow the curvature of the rail, resulting in a change in the aiming direction of the nozzle.

In another example, as indicated at 718, adjusting the nozzle aiming direction may include actuating an actuator of the traction system based on the detected curvature. For example, the nozzle and/or passage coupled to the nozzle may be coupled to an actuator such as a stepper motor, and the controller may send a signal to the stepper motor to move the nozzle to an indicated aiming direction that is a function of the surface curvature, as explained above with respect to FIG. 2.

In a further example, as indicated at 720, adjusting the nozzle aiming direction may include transferring relative motion between the vehicle frame and wheel set to the nozzle, as explained above with respect to FIGS. 3-6. For example, the flexible coupling of the nozzle may be provided by a lever bracket mounted to a frame of the vehicle and mounted to the passage (e.g., the pipe, tube, or hose), and a resilient member may be coupled between the lever bracket and a journal bearing housing or other structure of a lead axle of the vehicle. The lever bracket transforms lateral movement of the frame relative to the lead axle in a first direction to lateral movement of the nozzle in a second, opposite direction, as the curvature of the surface changes. Method 700 then returns.

Figure 8:
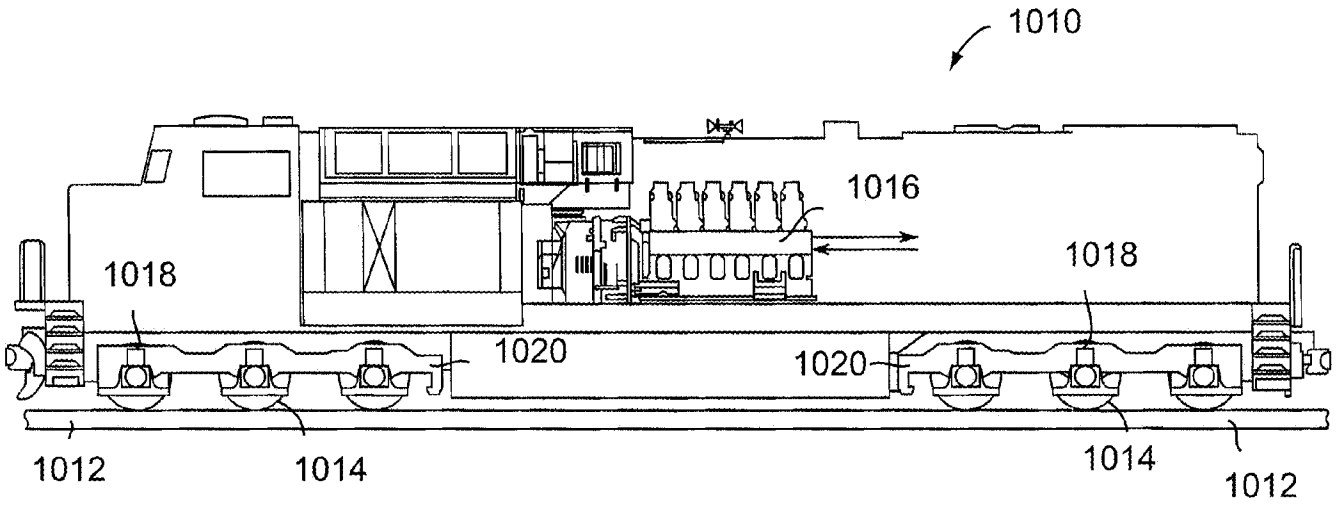
FIG. 8 is a schematic drawing of an exemplary rail vehicle.

FIG. 8 is a schematic diagram of a rail vehicle 1010, herein depicted as a locomotive, configured to run on a rail 1012 via a plurality of wheels 1014. As shown therein, the rail vehicle 1010 includes an engine 1016, such as an internal combustion engine. A plurality of traction motors 1018 are mounted on a truck frame 20, and are each connected to one or more of the plurality of wheels 1014 to provide tractive power to selectively propel and retard the motion of the rail vehicle 1010.

Figure 9:
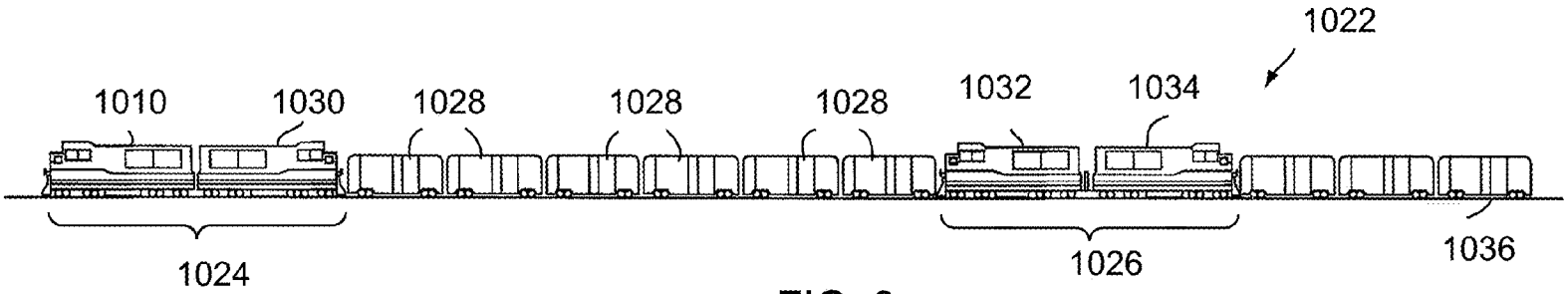
FIG. 9 is a schematic drawing of a rail vehicle consist, according to an embodiment of the present invention.

As shown in FIG. 9, the rail vehicle 1010 may be a part of rail vehicle consist 1022. The consist may include a lead locomotive consist 1024, a remote or trail locomotive consist 1026, and plural non-powered rail vehicles (e.g., freight cars) 1028 positioned between the two consists 1024, 1026. The lead locomotive consist 1024 may include a lead locomotive, such as rail vehicle 1010, and trail locomotive 1030. The remote locomotive consist 1026 also may include a lead locomotive 1032 and a trail locomotive 1034. All of the rail vehicles in the consist are sequentially mechanically connected together for traveling along a rail track or other guideway 1036.

Figure 10:
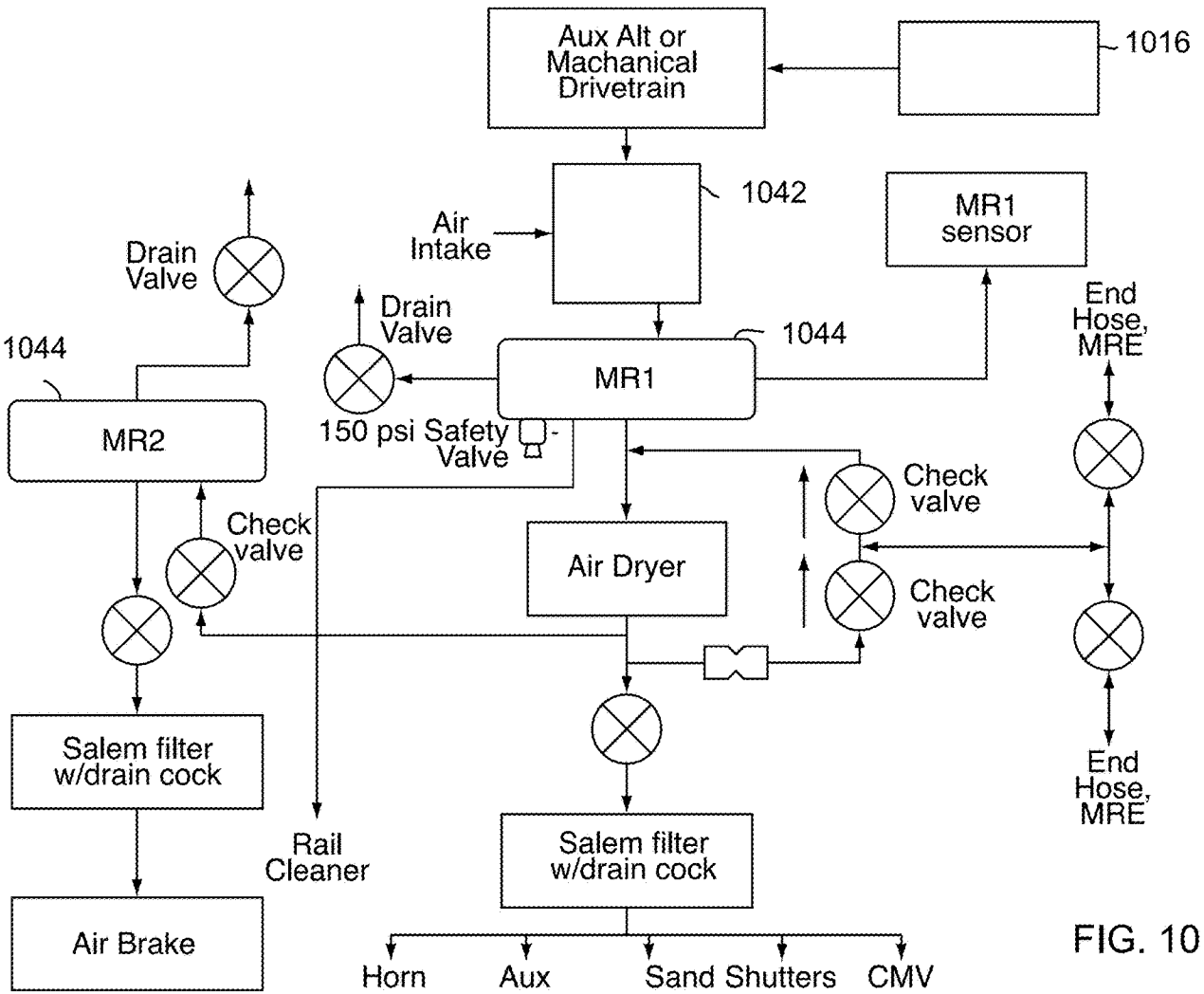
FIG. 10 is a flow diagram of a compressed air system of a rail vehicle, according to an embodiment of the present invention.

As alluded to above, one or more of the locomotives 1010, 1020, 1032, 1034 in the consist 1022 may have an on-board compressed air system for supplying one or more functional systems of the consist 1022 with compressed air. In an embodiment, each of the locomotives in the consist may be outfitted with a compressed air system. In other embodiments, fewer than all but at least one of the locomotives in the consist may be outfitted with a compressed air system. A flow diagram illustrating an exemplary compressed air system 1040 is shown in FIG. 10. As shown therein, the compressed air system 1040 includes an air compressor 42 driven by the engine 1016. As is known in the art, the air compressor 1042 intakes air, compresses it and stores it in one or more main reservoirs 1044 on-board the locomotive. The compressed air from the main reservoirs may then be utilized by various systems within the consist, such as an air braking system, horn, sanding system, and adhesion control/tractive effort system. As discussed below, the main reservoir on-board each locomotive is fluidly coupled to the main reservoir on-board the other locomotives in the consist through a main reservoir equalizing (MRE) pneumatic trainline. As used herein, "fluidly coupled" or "fluid communication" refers to an arrangement of two or more features such that the features are connected in such a way as to permit the flow of fluid between the features and permits fluid transfer.

Figure 11:
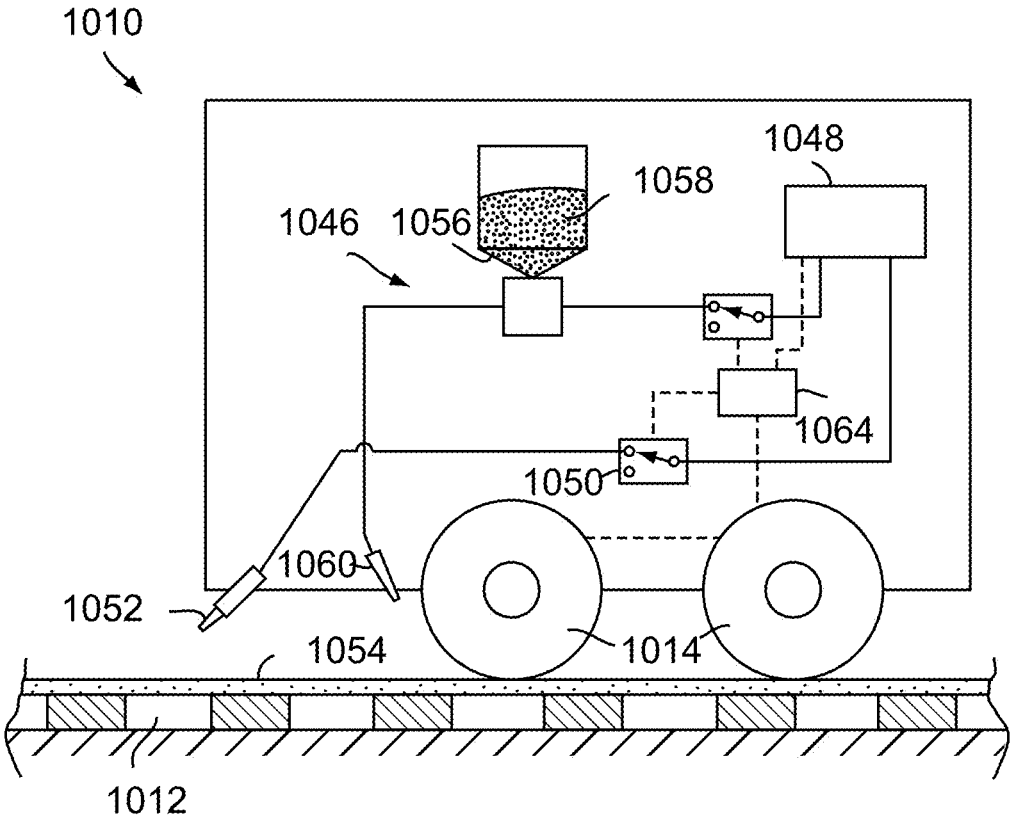
FIG. 11 is a schematic drawing of a tractive effort system on a rail vehicle, according to an embodiment of the present invention.

In an embodiment, the adhesion control/tractive effort system may be any high velocity, high flow tractive effort control system known in the art, such as those disclosed in PCT Application No. PCT/US2011/042943, which is hereby incorporated by reference herein in its entirety. For example, as shown in FIG. 11, a tractive effort system 1046 includes a supply of pressurized air 1048. The supply of pressurized air may be a main reservoir on board the locomotive or the MRE pneumatic trainline (wherein the pressurized air may be supplied by one or more air compressors within the locomotive consist). The supply of pressurized air is fluidly coupled, through a pressurized air control valve 1050, to a nozzle 1052 oriented to direct a high velocity, high flow of air jet to a contact surface 1054 of the rail 1012. The tractive effort system 1046 may also include a reservoir 1056 for holding a supply of tractive material 1058, such as sand, and a nozzle 1060 fluidly coupled to the reservoir 1056 via a tractive material control valve and oriented to direct a flow of tractive material 1058 to the contract surface 1054 of the rail.

In an embodiment, the air nozzle 1052 is positioned to direct a high flow, high velocity air jet to the rail in front of the lead axle of a lead locomotive in a locomotive consist. In other embodiments, both lead and trail locomotives may have tractive effort systems 1046. In addition, tractive material nozzle 1060 is positioned to direct a flow of tractive material to the rail in front of and behind both the lead and trail axles of a locomotive.

Figure 12:
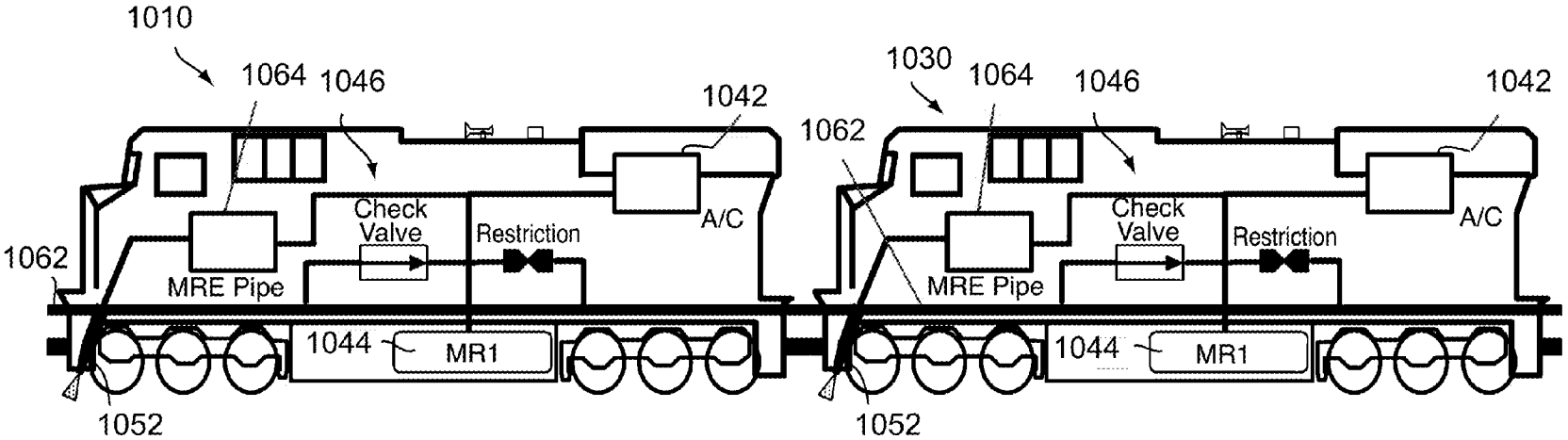
FIG. 12 is a schematic drawing of a tractive effort system equipped rail vehicle consist, according to an embodiment of the present invention.

FIG. 12 shows two locomotives 1010, 1030 coupled together in a consist. Each locomotive has a tractive effort system 1046 thereon. As shown therein, an air compressor 1042 on board each locomotive is configured to supply compressed air to a main reservoir 1044. The main reservoirs 1044 of each locomotive are fluidly coupled to one another via the MRE pneumatic trainline 1062. In this manner, each locomotive with an air compressor 1042 and main reservoir 1044 feeds the MRE trainline 1062 through a restrictive path. This restriction may be a specific orifice or the restriction associated with an air dryer. The main reservoirs 1044 of each locomotive are also fluidly coupled to the air nozzle 1052 of the tractive effort system 1046 for supplying the nozzles with pressurized air. Moreover, as shown therein, each tractive effort system 1046 is electrically coupled to a control unit 1064 on board the locomotives for controlling the tractive effort systems in accordance with embodiments of the present invention, as discussed below.

While FIG. 12 illustrates a two locomotive consist with tractive effort systems 1046 on each locomotive, there may be any combination of both tractive effort quipped and non tractive effort equipped locomotives in a conventional or distributed power consist. Moreover, the locomotives in the consist may include locomotive to locomotive communication in the form of a standard wired trainline, a high bandwidth communications link such as trainline modem or Ethernet trainline, or distributed power (remote or radio controlled). In some embodiments, there may be no communication between locomotives.

In an embodiment, a system and method for tractive effort consist optimization is provided. As will be readily appreciated, for any locomotive consist, such as that shown in FIG. 12, there will typically be at least one air compressor available to contribute to the total compressed air need of the consist. In an embodiment, a method for tractive effort consist optimization includes maximizing the air to the lead-most tractive effort system position. If locomotive to locomotive communication is present, then the detailed configuration of the tractive effort system configuration within the consist may be easily determined/sensed using known methods and shared among the locomotives.

Figure 13:
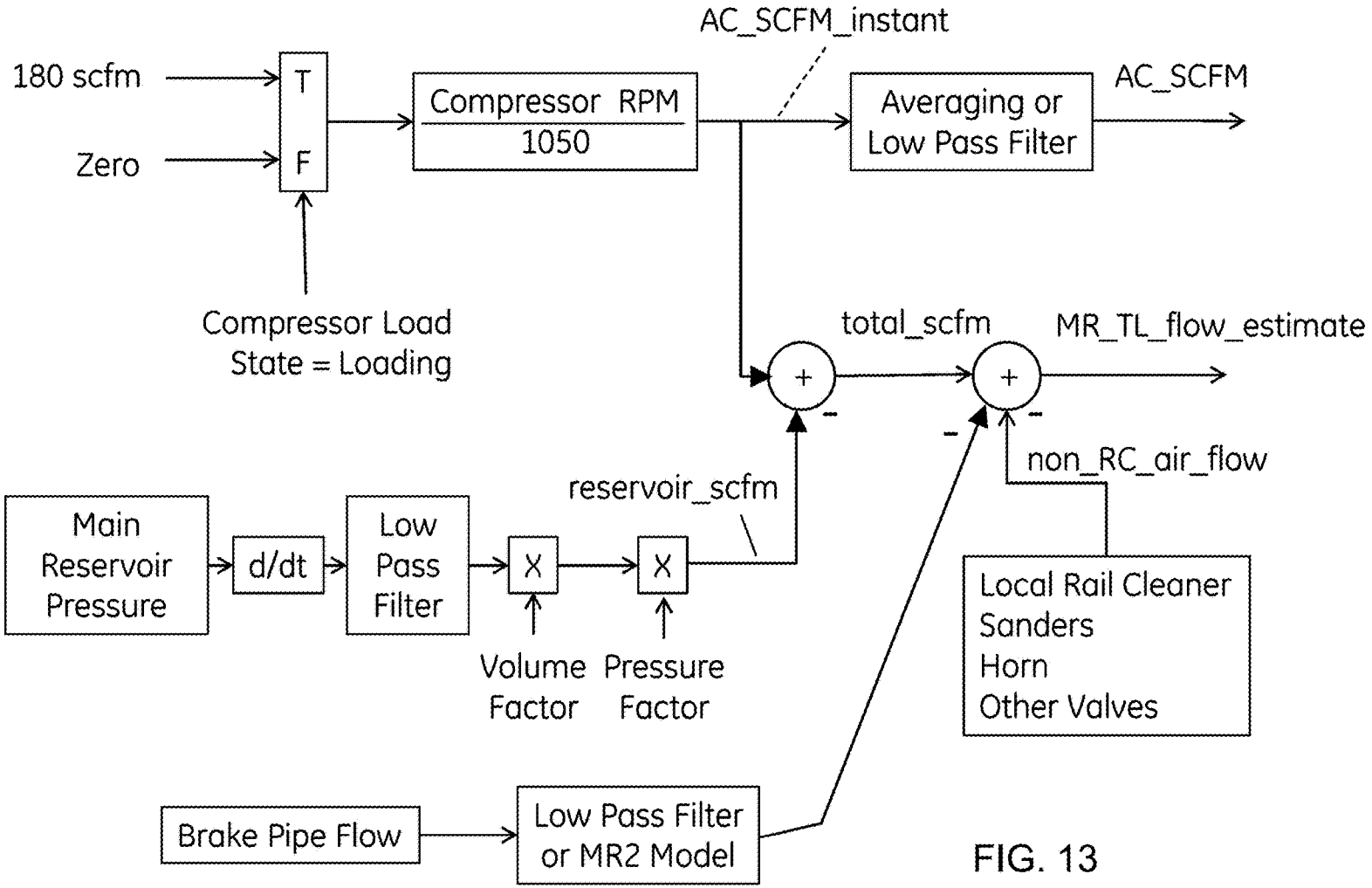
FIG. 13 is a flow diagram illustrating a method for estimating the air flow delivered to an MRE trainline, according to an embodiment of the present invention.

More typically, however, each locomotive may only know the lead/trail status of itself, the air flow to the brake pipe if the locomotive is a lead locomotive, and the direction of the locomotive (short hood/long hood). In this situation, at least one of the locomotives within the consist must be able to determine if there is a tractive effort system in the consist. In connection with this, FIG. 13 is a flow diagram illustrating a method to estimate the air flow delivered to the MRE pneumatic trainline 1062. As shown therein, in an embodiment, a control unit on-board one of the locomotives may utilize integrated control information regarding air compressor speed and load state, reservoir air pressure derivatives and the states of other pneumatic actuators or loads within the vehicle to develop an approximate value of air flow to the MRE pipe 1062. From this value, the control unit is able to determine whether or not a particular locomotive is configured with a tractive effort system.

In an embodiment, for a lead locomotive having a tractive effort system without variable flow, determining tractive effort system configuration is not needed. In this situation, the tractive effort system 1046 of the lead locomotive is enabled by the control unit 1064, e.g., by actuating the air control valve 1050, until the pressure in the main reservoir 1044 is less than approximately less than 110 psi (758 kPa). For a lead locomotive having a tractive effort system with variable flow, however, the control unit 1064 is configured to automatically adjust the flow through the air control valve 1050 to the maximum level that maintains a pressure in the main reservoir 1044 above approximately 110 psi. In both of these instances, the air compressor 1042 is controlled by the control unit 1064 to maximum flow if the main reservoir pressure is less than approximately 135 psi (930 kPa) and is shut off at approximately 145 psi (1000 kPa).

In an embodiment, for a lead locomotive without a tractive effort system and having a communication link to a trail locomotive, the configuration of the tractive effort system(s) within the consist is first determined via the communication link. As discussed above, if there is no communication link to a trail locomotive, a tractive effort system elsewhere in the consist may be determined by estimating the air flow delivered to the MRE pipe 1062. In both of these situations, if a trail locomotive has a tractive effort system, the air compressor is loaded to maximum flow if the main reservoir pressure is less than approximately 135 psi and is shut off at approximately 145 psi.

In another embodiment, for a trail locomotive having an on-board tractive effort system and having a communication link to a lead locomotive, the configuration of the tractive effort system(s) within the consist is first determined via the communication link. If a more leading locomotive has a tractive effort system, the tractive effort system of the trail locomotive is enabled so long as the pressure within the main reservoir 1044 of the trail locomotive is above approximately 141 psi. As will be readily appreciated, this maximizes the air to the more leading locomotive. As used herein, "more leading" refers to a position of a locomotive within a consist physically ahead of another locomotive within the same consist. If there is not a more leading locomotive having a tractive effort system within the consist, the tractive effort system of the trail locomotive is enabled as long as the pressure within the main reservoir 1044 is above approximately 110 psi. If it determined that the trail locomotive is a final trail locomotive within the consist, and in a long hood direction, the tractive effort system 1046 is disabled by the control unit 1064. In any of these situations, the air compressor is loaded to maximum flow if the main reservoir pressure is less than approximately 138 psi and is shut off at approximately 145 psi.

For a tail locomotive having a tractive effort system wherein there is no communication to a lead locomotive in the consist, the configuration of tractive effort systems in the consist may again be determined by estimating the air flow delivered to the MRE pipe 1062. If another tractive effort system is detected/determined within the consist, the tractive effort system of the trail locomotive is enabled so long as the pressure within the main reservoir 1044 of the trail locomotive is above approximately 141 psi. In this situation, the air compressor is loaded to maximum flow if the main reservoir pressure is less than approximately 138 psi and is shut off at approximately 145 psi.

Lastly, for a trail locomotive without a tractive effort system, the configuration of tractive effort systems elsewhere in the consist is determined through the communications link to the lead locomotive, if present, or by estimating the MRE pipe air flow, as discussed above. If it is determined that another locomotive has a tractive effort system, then the air compressor is loaded to maximum air flow if the main reservoir pressure is less than approximately 135 psi and is shut off at approximately 145 psi.

As discussed above, a tractive effort system provides an increase in tractive effort by applying a high velocity, high flow air jet to the contact surface of a rail. As also disclosed above, various control logic is utilized to optimize the use of the tractive effort systems within a consist in dependence upon the position of the tractive effort systems within the consist, the capability of the air compressors within the consist and the compressed air demands of other systems in the consist. In order to sustain the high flow level required for the tractive effort systems to provide peak tractive effort performance improvements, flow to or through the tractive effort systems must be maximized while maintaining main reservoir pressure above a certain lower threshold. Accordingly, an embodiment of the present invention is directed to a system and method for optimizing the flow of compressed air to a tractive effort system and, more particularly, to a system and method for varying the flow to a tractive effort system (or to the air nozzle 1052 thereof) in order to maintain a required lower threshold pressure within the main reservoir 1044.

Figure 14:
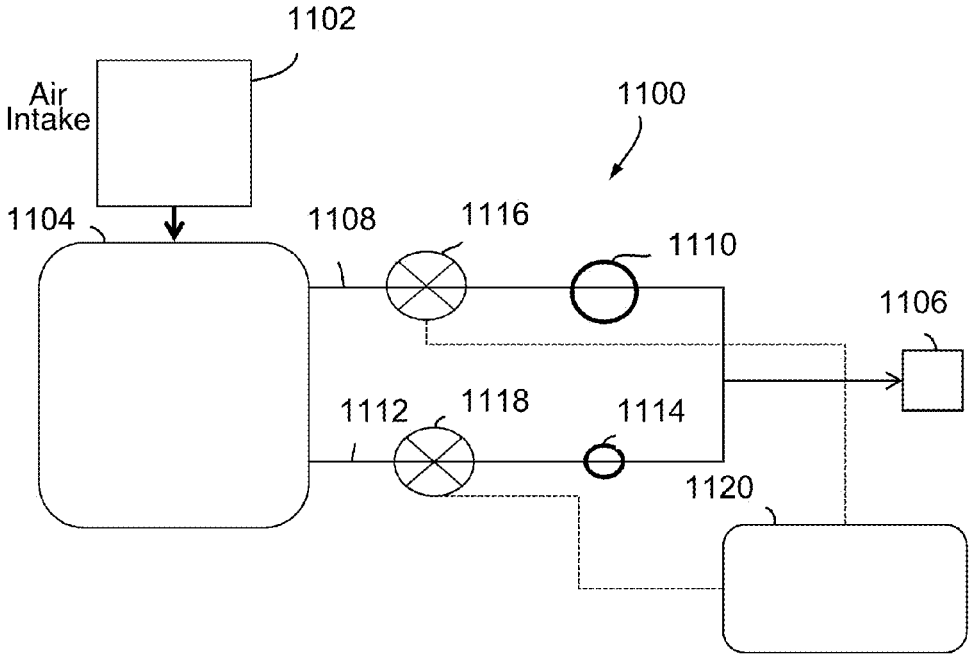
FIG. 14 is schematic drawing of a variable flow tractive effort system, according to an embodiment of the present invention.

With reference to FIG. 14, a variable flow system 1100 in accordance with an embodiment of the present invention is shown. As shown therein, an air compressor 1102 compresses air, which is stored in a main reservoir 1104 on board a rail vehicle or locomotive. The main reservoir 1104 is fluid communication with a tractive effort system 1106, such as that described above, through a first pathway 108 having a large orifice 1110 therein and a second pathway 1112 having a small orifice 1114 therein. A first valve, such as solenoid valve 1116 selectively controls the flow of compressed air through the first pathway 1108 and the large orifice 1110 to the tractive effort system 1106 and a second valve, such as second solenoid valve 1118, selectively controls the flow of compressed air through the second pathway 1110 and the small orifice 1114 to the tractive effort system 1108. A control unit is electrically coupled to the first and second valves 1116, 1118 and is configured to selectively control the first and second valves 1116, 1118 between a first state, in which compressed air flows through the valves 1116, 1118, through the orifices 1110, 1114 and to the tractive effort system 1106, and a second state in which compressed air is prevented from flowing through the valves 1116, 1118.

In operation, the control unit detects the pressure within the main reservoir 1104 and controls the flow of compressed air from the main reservoir through either or both of the large orifice 1110 and small orifice 1114 in dependence upon the detected pressure. Generally, if tractive effort is needed and the pressure within the main reservoir is close to a predetermined lower threshold pressure, the control unit 1120 may control the second solenoid valve 1118 to its second state and the first solenoid valve 1116 to its first state such that a flow of compressed air through the small orifice 1114 only is permitted. As will be readily appreciated, a lower pressure in the main reservoir 1104 may be a result of other systems utilizing the available supply of compressed air, air compressors operating at less than maximum capacity, etc. If however, the pressure within the main reservoir 1104 is sufficiently high, the control unit 1120 may control both the first and second valves 1116, 1118 to their respective first states such that compressed air is permitted to flow through both the large and small orifices 1110, 1114. As will be readily appreciated, by controlling both valves to their respective first positions, maximum flow to the tractive effort system, and thus maximum tractive effort improvement, is achieved.

In an embodiment, with both the first and second valves 1116, 1118 in their respective first (enabled) states, thus enabling flow through both the large orifice 1110 and small orifice 1114, a flow of approximately 300 cubic feet per minute (cfm) to the nozzle(s) of the tractive effort system 1106 may be realized. In an embodiment, with only the first valve 1116 in its first (enabled) state, and thus flow through the large orifice 1110 only, a flow of approximately 225 cfm may be realized. Similarly, with only the second valve 1118 in its first (enabled) state, and thus flow through the small orifice 1114 only, a flow of approximately 150 cfm may be realized. Given these expected flow rates when flow is enabled through either the large, small or both orifices 1110, 1114, a control strategy that maximizes the flow to the tractive effort system in dependence upon the available pressure within the main reservoir may be generated. As will be readily appreciated, the flow to a tractive effort system may be maximized by cycling between the options described above (e.g., first valve enabled, second valve disabled; second valve enabled, first valve disabled; both valves enabled; both valves disabled), in dependence upon the pressured detected within the main reservoir at any given time.

Figure 15:
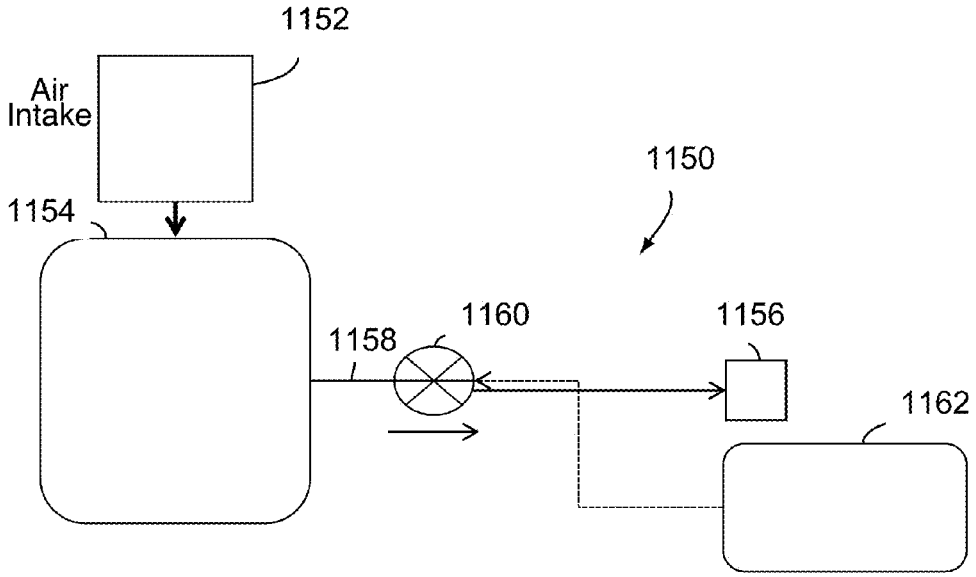
FIG. 15 is a schematic diagram of a variable flow tractive effort system, according to another embodiment of the present invention.

With reference to FIG. 15, a variable flow system 1150 in accordance with another embodiment of the present invention is shown. As shown therein, an air compressor 1152 compresses air, which is stored in a main reservoir 1154 on board a rail vehicle or locomotive. The main reservoir 1154 is fluid communication with a tractive effort system 1156, such as that described above, through a pathway 1158 having a continuously variable orifice 1160 therein. The size of the continuously variable orifice 1160 is controllable by a control unit 1162. In operation, when use of the tractive effort system 1106 is necessary to increase tractive effort, the pressure within the main reservoir 1154 is continuously monitored and the size of the variable orifice 1160 is varied in order to maintain the pressure in the main reservoir 1154 above a predetermined lower threshold pressure. In an embodiment, the lower threshold pressure is approximately 110 psi. In particular, the size of the orifice is adjusted based on the available main reservoir pressure. As discussed above, maintaining the pressure within the main reservoir 1154 above a lower threshold, namely 110 psi, is necessary to ensure that there is sufficient pressure to be utilized by other functional systems within the consist. In an embodiment, the size of the orifice is controlled by a continuously variable orifice valve.

In other embodiments, other flow control devices may be utilized to control the flow of air from the main reservoir to a tractive effort system in order to maintain a predetermined lower threshold pressure in the main reservoir. For example, the present invention contemplates the use of position displacement and/or vein valve devices to allow variable flow that enables the system to maximize air flow at any given time. In yet another embodiment, a secondary compressor may be utilized to either solely supply air to the tractive effort system, to supplement the compressed air supplied by the main reservoir, or to supply air to the main reservoir to maintain the pressure therein above the predetermined lower threshold.

Figure 16:
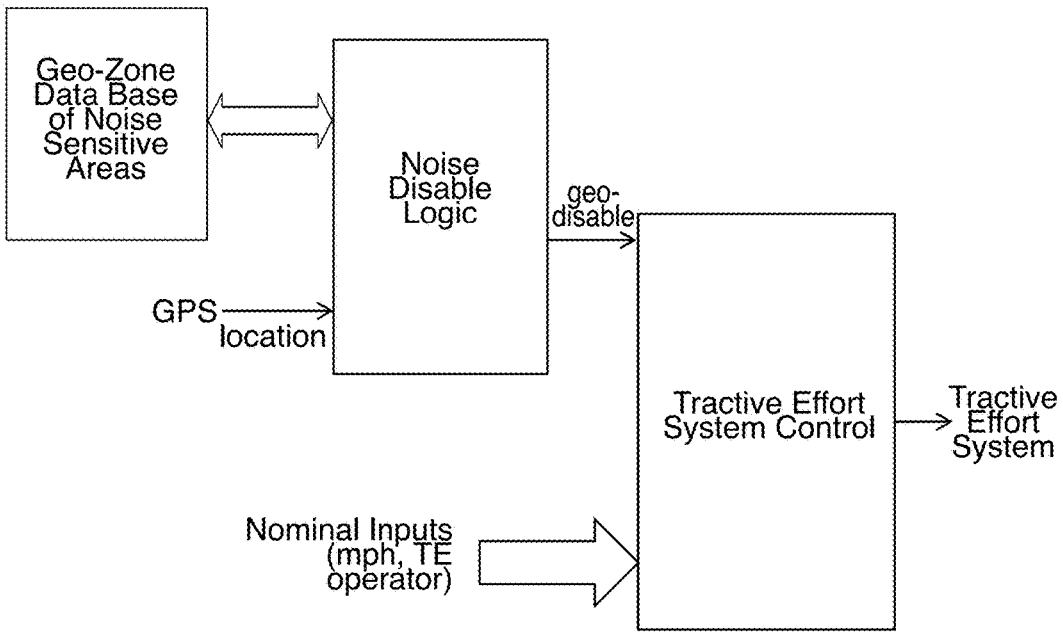
FIG. 16 is a block diagram illustrating the implementation of a smart-disable control strategy for a noise-sensitive area, according to an embodiment of the present invention.

Adhesion control systems and methods according to the present invention also provide the ability to disable a tractive effort system(s) within a consist in cases where enablement of the tractive effort system may be undesirable. For example, it may be desirable to disable the tractive effort system(s) in situations where operation of the system(s) may have a negative impact on locomotive performance. In an embodiment, the control unit may be configured to disable the tractive effort enhancement system(s) when one or more adverse conditions are present. In particular, the control unit on a locomotive, such as a lead locomotive, may automatically disable the tractive effort system on-board the locomotive in an area where the audible noise generated during use of the tractive effort system is objectionable. For example, information regarding residential or noise-sensitive areas may be stored in memory of a control unit and GPS may be utilized to monitor the geographical position of a consist. When the consist approaches an area stored in memory as being a noise-sensitive area, the control unit may automatically suspend use or disable the tractive effort system. FIG. 16 is a block diagram illustrating the implementation of a smart-disable control strategy wherein the adverse condition is a noise-sensitive area. (Generally, "adverse" condition refers to a condition which is designated as a basis for control of the tractive effort system, which may include turning off or disabling the tractive effort system.)

Figure 17:
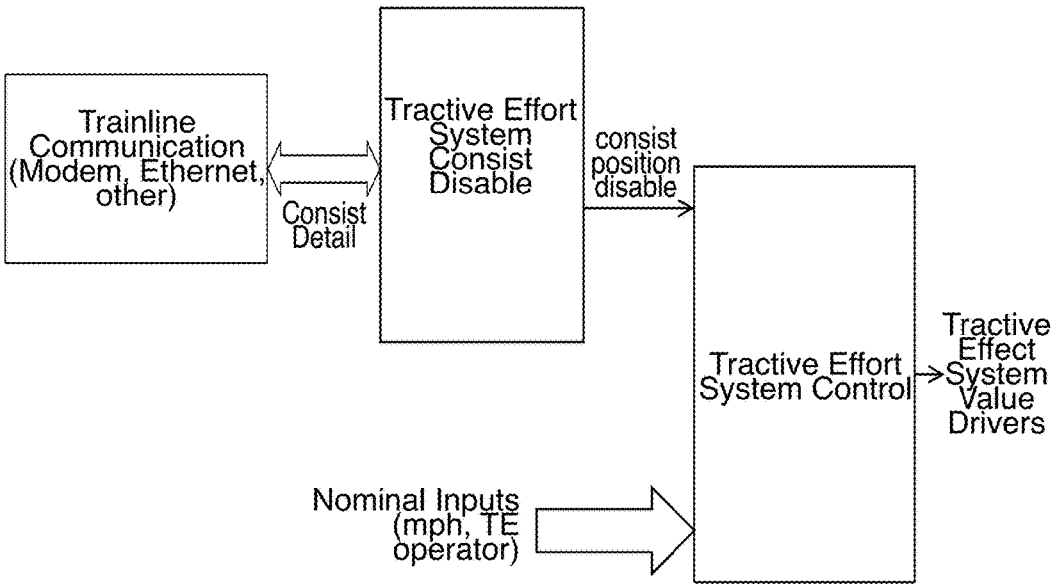
FIG. 17 is a block diagram illustrating the implementation of a smart-disable control strategy for a tractive effort system having minimal positive impact, according to an embodiment of the present invention.

In another embodiment, the control unit may disable the tractive effort system in a consist position where an active tractive effort system may have minimal positive or even negative impact on overall consist tractive effort (e.g., due to the location of a consist on grade and the position of the tractive effort system within the consist). FIG. 17 is a block diagram illustrating the implementation of a smart-disable control strategy wherein the adverse condition is for consist characteristics that translate to the tractive effort system having a minimal positive impact.

Figure 18:
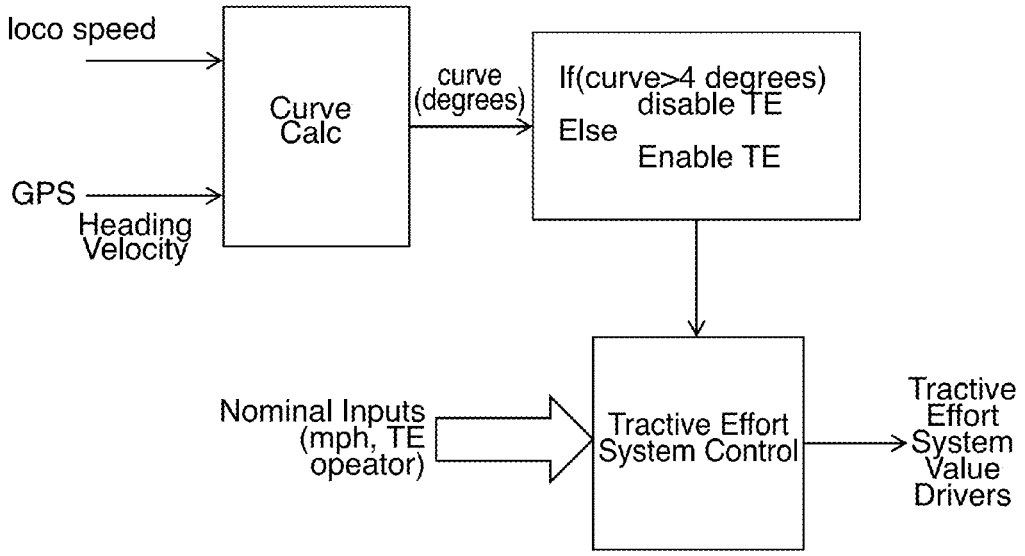
FIG. 18 is a block diagram illustrating the implementation of a smart-disable control strategy based on GPS heading information, according to an embodiment of the present invention.

In other embodiments, the control unit may be configured to disable the tractive effort system when the locomotive on which the tractive effort system is configured is traversing a curve of a sufficiently small radius to cause reduced performance. As will be readily appreciated, reduced performance may be due to, for example, the misalignment of the nozzle of the tractive effort system relative to the contact surface of the rail, among other factors. In connection with this embodiment, the radius of a curve may be sensed or calculated and/or various sensors may sense the position of the nozzle of the tractive effort system relative to the rail. These sensors may transmit data to the control unit and the control unit may disable the tractive effort system when misalignment of the nozzle with the contact surface of the rail is sensed. In addition, track data representing a curvature of the track at various locations may be stored in memory, and the control unit may be configured to disable the tractive effort system when the consist travels through these stored locations, as determined by GPS. FIG. 18 is a block diagram illustrating the implementation of a smart-disable control strategy based on GPS heading information. As shown therein, in an embodiment, locomotive speed and heading velocity is input into the control system. A curve calculation is carried out to determine the amount of curve in the track. If the curve is greater than approximately 4 degrees, the tractive effort system is disable. If the curve is less than approximately 4 degrees, the tractive effort system is enabled.

Figure 19:
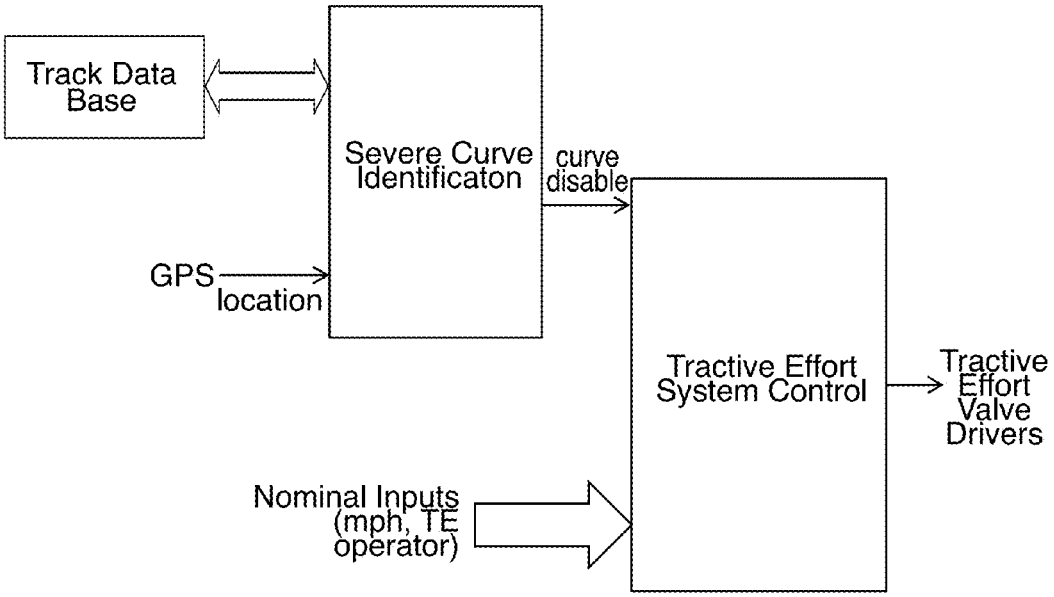
FIG. 19 is a block diagram illustrating the implementation of a smart-disable control strategy based on GPS location information, according to an embodiment of the present invention.

Similarly, FIG. 19 is a block diagram illustrating the implementation of a smart-disable strategy based on GPS location information and a track database. As shown therein, under this method, information regarding the curvature of a track at various locations along a route of travel is stored in memory. GPS is utilized to sense a location of the consist such that when the consist is in a location where a "severe" curve is known to exist, the tractive effort system will be disable by the control unit. As used herein, "severe curve" means a curve greater than approximately 4 degrees.

Figure 20:
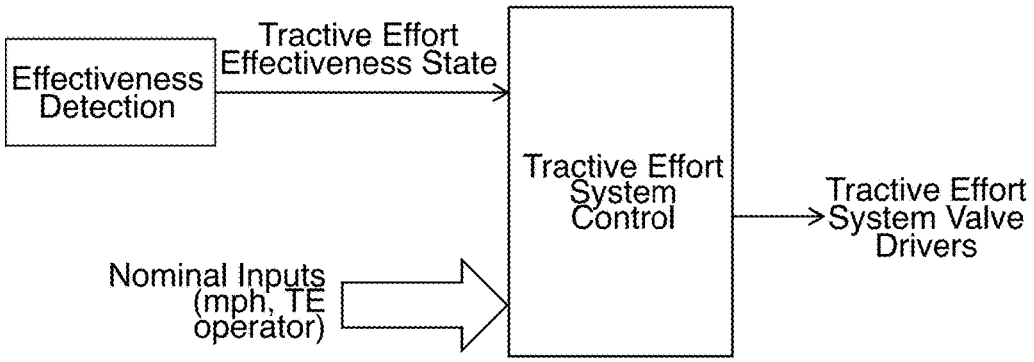
FIG. 20 is a block diagram illustrating the implementation of a smart-disable control strategy based on tractive effort system effectiveness, according to an embodiment of the present invention.

In yet other embodiments, the control unit may be configured with an adaptive control strategy capable of "learning" of a negative impact that enablement of a tractive effort system may have. Causes of negative impact include adverse weather conditions that are found to disturb the normally positive impact of a tractive effort system such as snow on the roadbed (which could blow up on the rail if the system were enabled) or cold temperatures (which may interact with the air blast from the nozzle) to cause a freezing of moisture on the rail). Other adverse conditions may include unusual dust or debris on the roadbed which may be blown onto the track by the system to reduce adhesion. FIG. 20 is a block diagram illustrating the implementation of a smart-disable strategy wherein the control unit disables the tractive effort system if a negative impact of the tractive effort system is detected or measured. In particular, as shown in FIG. 20, the control unit may be configured to disable the tractive effort system if effectiveness of the system does not reach a predetermined threshold. Systems and methods for determining effectiveness of a tractive effort system are discussed hereinafter.

In connection with the adhesion control systems and methods described above, the tractive effort enhancement systems are configured to automatically enable or disable when needed to produce an increase in tractive effort in dependence upon tractive effort position within a consist, sensed track conditions, sensed position of the consist, etc. In certain situations, however, it is also desirable to provide a means for an operator to manually enable one or more tractive effort systems on the consist prior to the control unit automatically enabling such systems. That is, it is sometimes desirable to manually enable a tractive effort system regardless of any automatic control functionality, such as that disclosed hereinbefore. As will be readily appreciated, this may be advantageous where an operator recognizes a rail condition visually, based on past experiences or other reasoning. Moreover, an operator may need to quickly and/or momentarily disable the tractive effort system(s) due to special circumstances such as to avoid debris or to avoid kicking up loose particles or debris on the road bed that could damage the locomotives or other nearby equipment.

Figure 21:
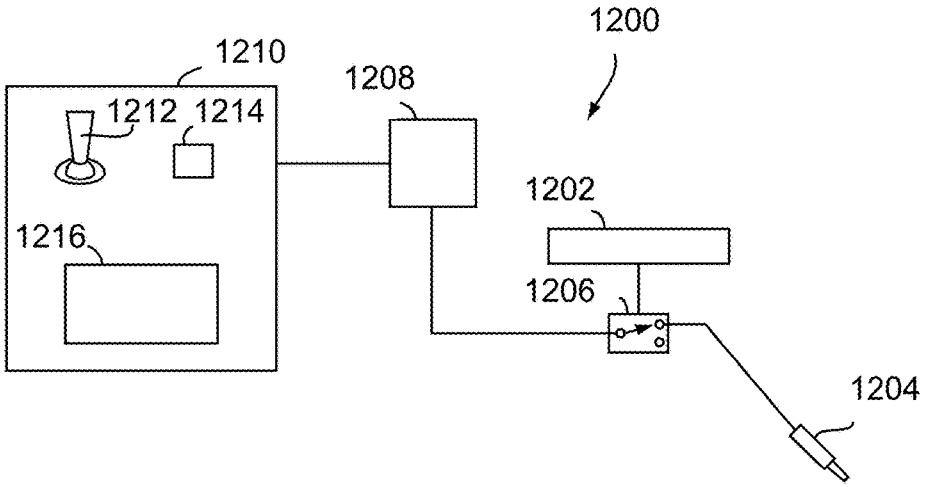
FIG. 21 is a schematic drawing of a tractive effort system having an operator interface, according to an embodiment of the present invention.

In an embodiment, a tractive effort system 1200 having an operator interface is provided. As shown in FIG. 21, the tractive effort system 1200 may be substantially similar to the tractive effort systems disclosed above and includes a supply of compressed air, such as a main reservoir 1202 on-board a locomotive or a MRE pneumatic trainline, a nozzle 1204 fluidly coupled to the main reservoir 1202 for directing a high flow of air to a contact surface of the rail, a control valve 1206 for selectively enabling or disabling the flow of compressed air from the main reservoir 1202 to the nozzle, and a control unit 1208 electrically coupled to the control valve 1206 for controlling the valve 1206, and thus the tractive effort system, between its enabled state and disabled state. As shown in FIG. 21, an operator interface 1210 is electrically coupled to the control unit 1208.

The operator interface 1210 includes a momentary disable switch 1212 and a monostable button 1214. In an embodiment, the momentary disable switch 1212 may be a hardware spring return mono-switch which is biased to an "enable" position in which tractive effort system 1200 is controlled automatically in accordance with the control logic and methods disclosed above. The momentary disable switch 1212 is movable against the bias by an operator to a "disable" position in which a signal is sent to the control unit 1208, and thus to the valve 1206 of the tractive effort system 1200, to disable the tractive effort system. In an embodiment, an operator must hold the switch 1212 in the "disable" position continuously to maintain the tractive effort system in the manually disabled state. If the operator releases the momentary disable switch 1212, the switch springs back to the "enable" position wherein automatic control of the tractive effort system 1200 by the control unit 1208 is resumed. As will be readily appreciated, the momentary disable switch 1212 may be useful in situations where an operator wishes to disable the air blast to the rail for a short period of time, such as when crossing a public roadway or the like.

Figure 22:
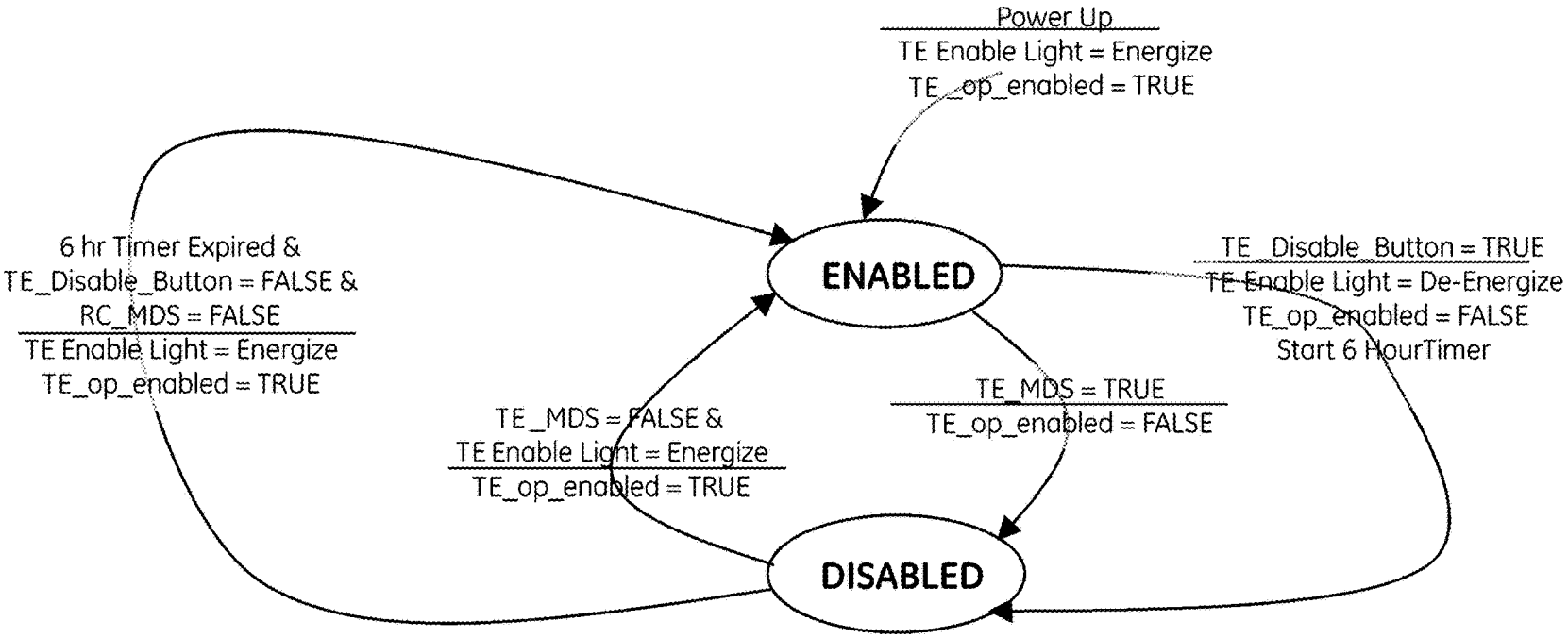
FIG. 22 is a state machine diagram illustrating the response of a tractive effort control system to operator inputs, according to an embodiment of the present invention.

The monostable button 1214 is configured to toggle the state of the tractive effort system 1200 between "enabled" and "disabled" when pressed by an operator. The state, whether enabled or disabled, may be displayed to the operator on a display 1216. The indication to the operator of the disabled or enabled state of the tractive effort system 1200 may be in the form of a light or screen icon on the display 1216. In an embodiment, the indication may be a dial indicator or audio indicator, such as an audible tone. In an embodiment, the control unit 1208 is configured to control the tractive effort system 1200 back to its enabled state after at least one of a designated time has elapsed, a designated distance has been traversed, a designated throttle transition has occurred, the direction hand has been centered, a manual sand switch has been pressed or changed state, a certain vehicle speed change or level has occurred, the locomotive is within a certain geographical region, certain predetermined locomotive power or tractive effort levels have been attained, and/or certain other operator actions have been detected or sensed. FIG. 22 is a state machine diagram illustrating how the control unit 1208 responds to direct operator inputs (i.e., the momentary disable switch 1212 and monostable button 1214) to control operation of the tractive effort system 1200. In this implementation, a timer or a control system power-up is used to resent the tractive effort system 1200 to an enabled state.

As discussed above, tractive effort systems in accordance with the present invention may, in addition to having a high-flow rate compressed air nozzle, may include a sanding nozzle for distributing sand or tractive material to the contact surface of the rail. Such a system was described above with reference to FIG. 11. As will be readily appreciated, the tractive material/sand may be mixed with a flow of pressurized air and driven at high velocity onto the rail to increase tractive effort, or may be simply deposited onto the contact surface of the rail without being entrained in a flow of pressurized air. Indeed, sanding has been commonly used in the rail industry to enhance the friction between the wheel/rail interface through sanding at the contact surface of the rail. Customarily, sand or other tractive material is applied in front of an axle in wet rail conditions or in other conditions where slippage may occur. Known sanding strategies include "automatic sand," wherein sand is automatically applied in front of both trucks of a locomotive, "manual lead," wherein sand is applied in front of the leading locomotive axle only and is manually enabled by an operator, and "manual trainline," wherein sand is applied in front of both trucks of all locomotives within the consist and is manually enabled by an operator.

With improvements in tractive effort systems, such as the improvements contemplated by the adhesion control systems and methods of the present invention, higher tractive effort may be attained than was previously possible. These improvements in tractive effort may be leveraged to reduce the amount of sand used. As will be readily appreciated, reducing the amount of sand used is desirable, as it reduces railroad capital expense. Accordingly, the present invention also provides a control system and method that reduces the amount of sand or tractive material utilized.

In an embodiment, a system for controlling a consist of rail vehicles includes a tractive effort system on-board a rail vehicle. The tractive effort system may be of the type disclosed above in connection with FIG. 11 having both air blast and sand dispensing capabilities. In other embodiments, the sand dispensing may be separate from the compressed air pathway, as discussed above. A control unit, such as that disclosed above, is electrically coupled to the rail vehicle and is configured to control the tractive effort system to dispense both tractive material/sand, sand only or air only. In an embodiment, the control unit may include a processor having a control strategy stored in memory that is executable to provide a high-flow jet of compressed air as a preference before applying sand to the rail.

According to an embodiment of the present invention, for a consist utilizing an "automatic sand" strategy, the control unit may configured to monitor slip, individual axle tractive effort and overall locomotive tractive effort and horsepower, as hereinafter discussed. The control unit may include a control strategy wherein sand is enabled as a backup to compressed air only as a function of at least one of locomotive speed, locomotive tractive effort, time since the air only mode was activated, distance traversed since the tractive effort system was activated, geographical location, operator input and measured or inferred tractive effort reservoir levels. In an embodiment, the control system may be configurable to realize more sand savings as opposed to high tractive effort, and vise-versa.

Figure 23:
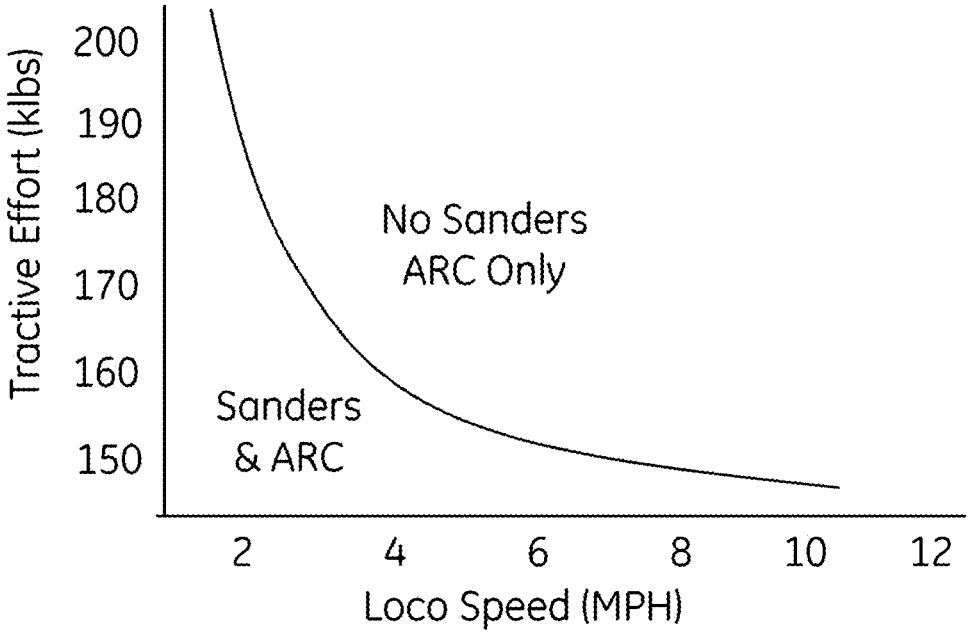
FIG. 23 is a graph FIG. 23 illustrating tractive effort threshold as a function of locomotive speed.
Figure 24:
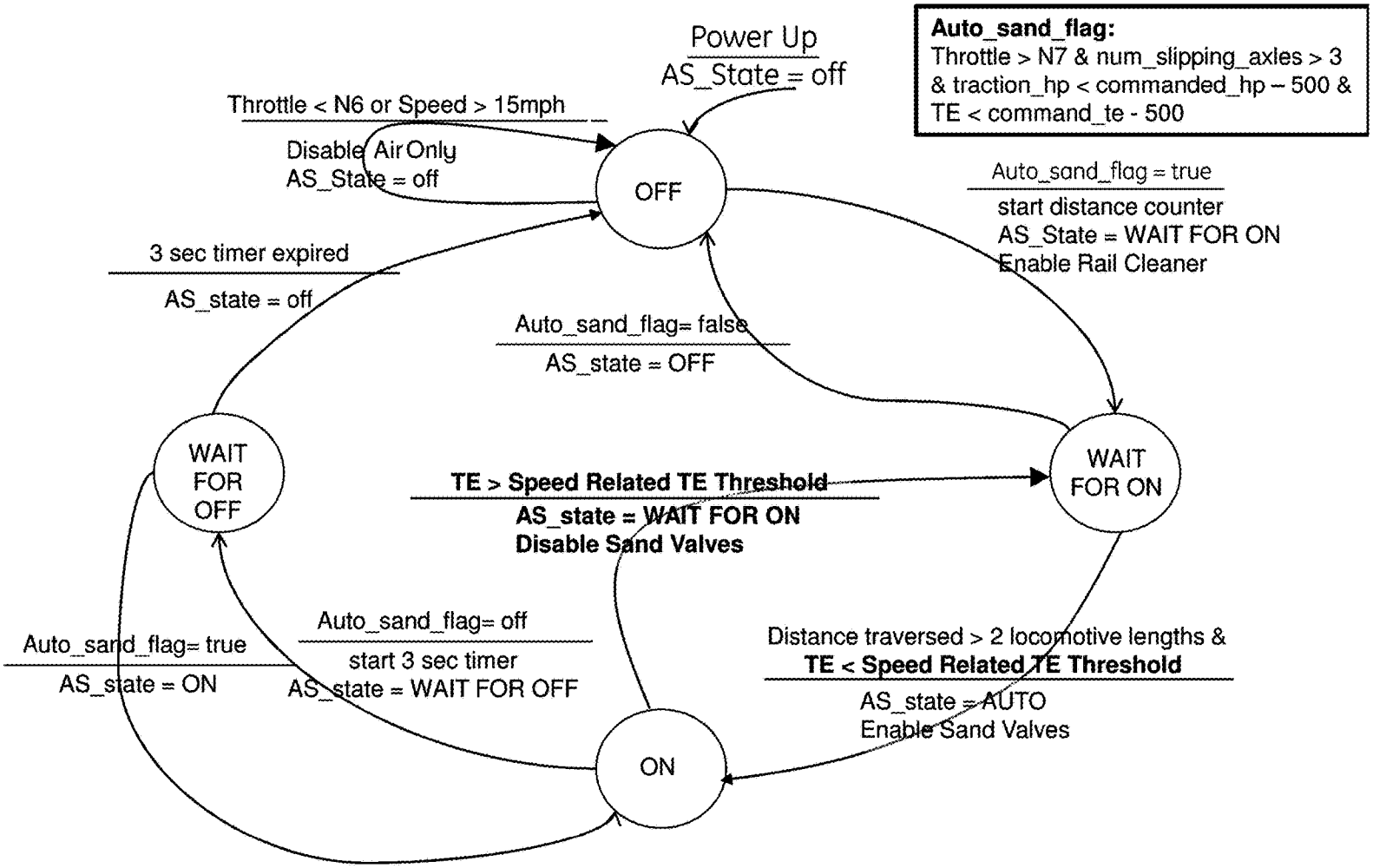
FIG. 24 is a state machine diagram illustrating a sand reduction control strategy for a tractive effort system, according to an embodiment of the present invention.

In yet another embodiment of a system for reducing the amount of sand/tractive material utilized, the control system may be configured to delay automatic sanding after the air only blast as long as a certain level of tractive effort is attained. This tractive effort threshold may be a function of a speed such that as the consist slows toward a stall or is slipping, a more aggressive sand application is initiated by the control unit/control system. In an embodiment, a tractive effort threshold is input into the control unit or stored in memory. Above this tractive effort threshold, auto-sanding is not initiated. This threshold may be automatically increased as speed is reduced so that at some lower speed, sand is always applied if there are any axels on the locomotive which are limited in tractive effort due to wheel slip. FIG. 23 illustrates an exemplary tractive effort threshold as a function of locomotive speed. FIG. 24 is a state machine diagram illustrating how the tractive effort threshold may be utilized by the control unit to control operation of the tractive effort system (i.e., sand only, air only or sand and air) in order to reduce the amount of sand or tractive material used.

Figure 25:
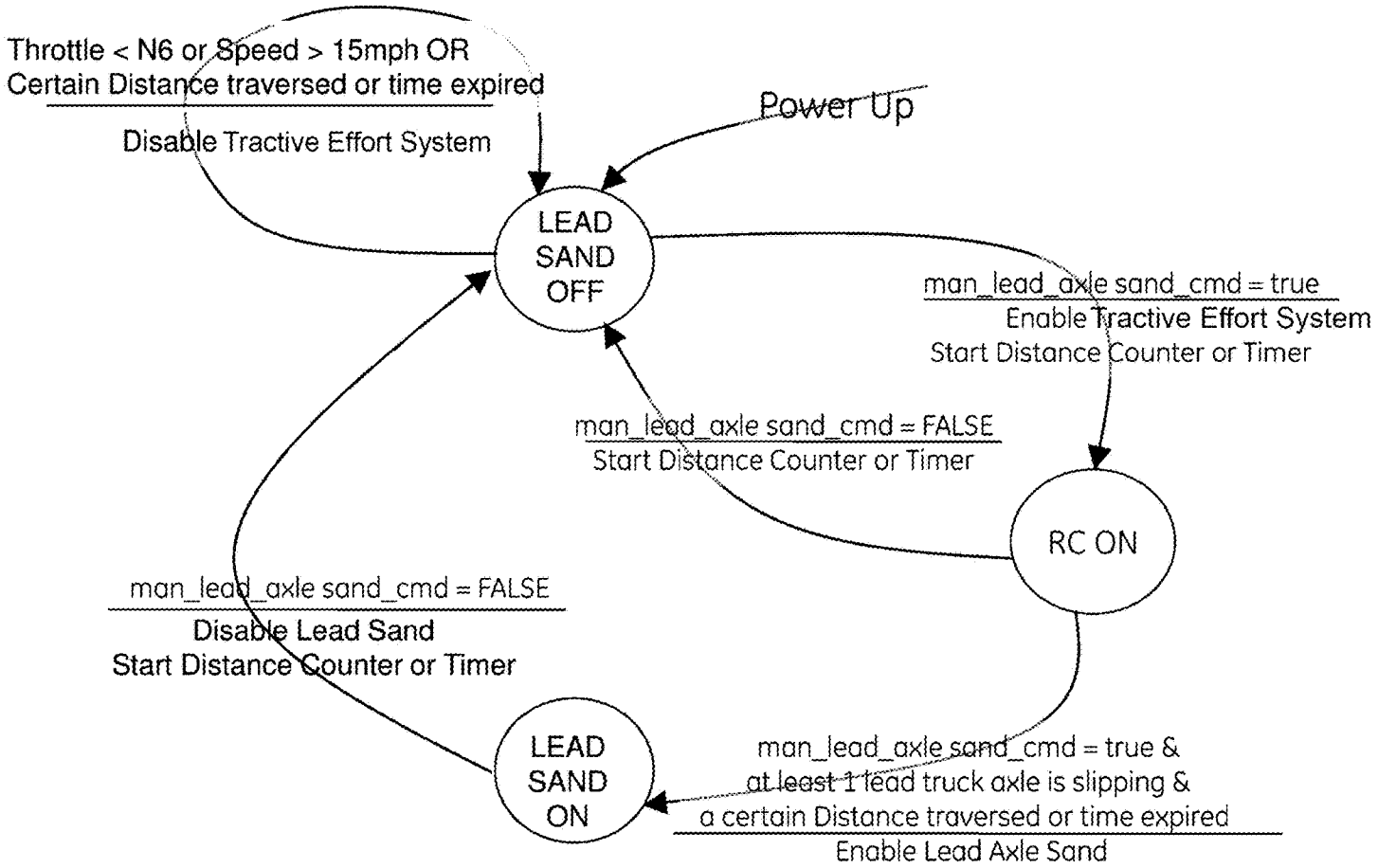
FIG. 25 is a state machine diagram illustrating another sand reduction control strategy for a tractive effort system, according to an embodiment of the present invention.

According to another embodiment of the present invention, a control system and method for reducing the amount of sand utilized under a "manual lead" sand strategy is provided. As discussed above, the manual lead axle sand command is typically issued when an operator wants to sand the lead axle independent of the automatic sand state. FIG. 25 is a state machine diagram illustrating an exemplary sand reduction control strategy for manual lead axle sanding. As shown therein, upon initiation of "manual lead" sanding, the air blast mode of the tractive effort system is automatically initiated as well. Once the air blast mode of the tractive effort system is enabled, it is maintained in the enabled state even if the operator input to the enable "manual lead" sand is removed. In this embodiment, the control unit is configured to deactivate or disable the tractive effort system (i.e., cease air blast) after some time or some distance. In another embodiment, the control unit is configured to deactivate or disable the tractive effort system (i.e., cease air blast) if the consist is past the apparent grade or slippage challenge as indicated by realized high train speeds or a throttle reduction. The embodiments of the present invention relating to sand reduction systems and methods disclosed herein are particularly applicable to situations where the throttle is in the "motoring position." It is contemplated, however, that similar control strategies for sand reduction are applicable in "dynamic braking modes" as well.

Figure 26:
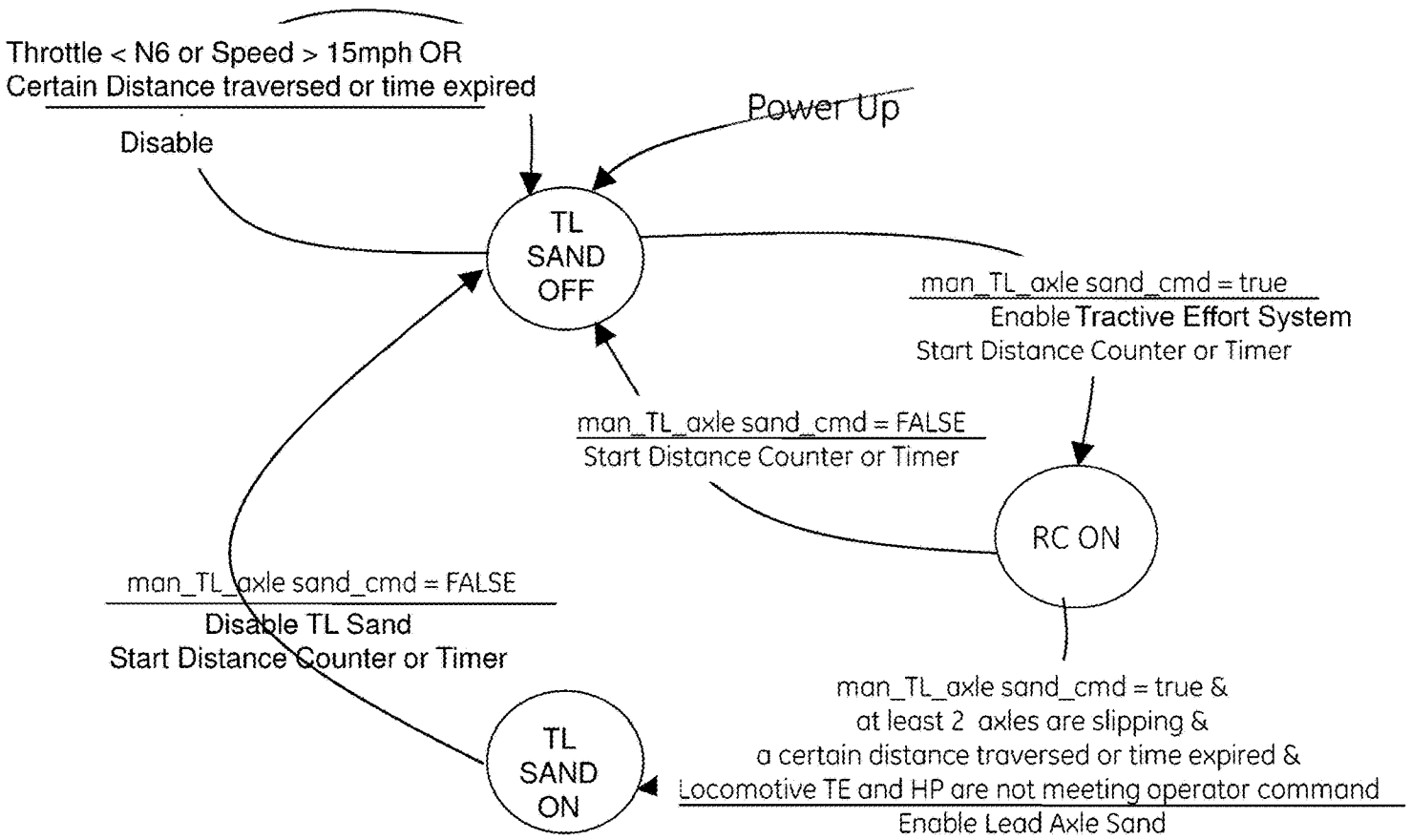
FIG. 26 is a state machine diagram illustrating another sand reduction control strategy for a tractive effort system, according to an embodiment of the present invention.

According to another embodiment of the present invention, a control system and method for reducing the amount of sand utilized under a "manual trainline" sand strategy is provided. As discussed above, the manual trainline sand command is typically issued when an operator desires to sand the lead axle on each truck of the trainline in addition to or independent of automatic sand. FIG. 26 is a state machine diagram illustrating an exemplary sand reduction control strategy for manual trainline sanding. As shown therein, upon initiation of "manual trainline" sanding, the air blast mode of the tractive effort system is automatically initiated as well. Once the air blast mode of the tractive effort system is enabled, it is maintained in the enabled state even if the operator input to the enable "manual trainline" is removed. In this embodiment, as with the sand saving method under "manual lead" sanding disclosed above, the control unit is configured to deactivate or disable the tractive effort system (i.e., cease air blast) after some time or some distance, or if the consist is past the apparent grade or slippage challenge as indicated by realized high train speeds or a throttle reduction.

In connection with the control systems and methods for high flow rate tractive effort systems disclosed above, the present invention also relates tractive effort diagnostic systems and methods. In particular, the present invention is also directed to systems and methods for detecting clogs in a tractive effort system, detecting leaks in a tractive effort system and for measuring or detecting the effectiveness of a tractive effort system. As will be readily appreciated, diagnosing the "health" of a tractive effort system or systems on board a rail vehicle consist is important to achieving and maintaining optimum tractive effort during travel. As will be readily appreciated, if a tractive effort system is clogged or has a leak, it may function less than optimally and provide less than optimal results. Moreover, tractive effort control systems may utilize information regarding the "health" of the tractive effort systems to generate and execute a more tailored control strategy therefor.

In one embodiment, a system and method for detecting clogs in a tractive effort system on-board a rail vehicle is provided. As discussed above, the tractive effort systems contemplated by the present invention utilize substantially high flow rates to clear debris from the rail of a track to increase tractive effort. These high flow rates used allow significant reductions in flow to be detected. In particular, the impact of air usage from enablement of a tractive effort system and the load on the air compressor to replace the compressed air in the main reservoir of a given rail vehicle or locomotive may be monitored.

As will be readily appreciated, any system that utilizes air from the main reservoir on-board a locomotive causes the pressure within the main reservoir to suddenly drop when the system is enabled. This is a direct result of compressed air being drawn from the reservoir faster than the air compressor can replace it. As the tractive effort systems having high flow air jets contemplated by the present invention are large consumers of compressed air, enablement of the system immediately results in a large, sudden and detectable drop in the pressure in the main reservoir. As the pressure in the main reservoir drops, the air compressor is activated to replace the compressed air within the main reservoir.

Figure 27:
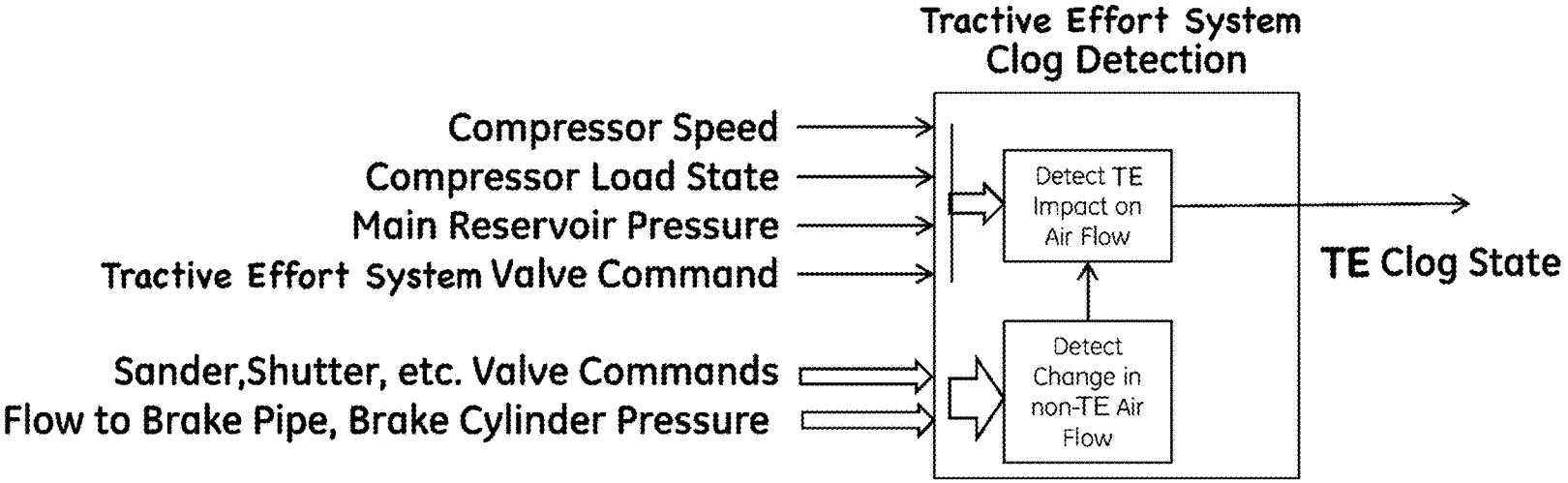
FIG. 27 is a block diagram illustrating a method for detecting clogs in a tractive effort system, according to an embodiment of the present invention.
Figure 28:
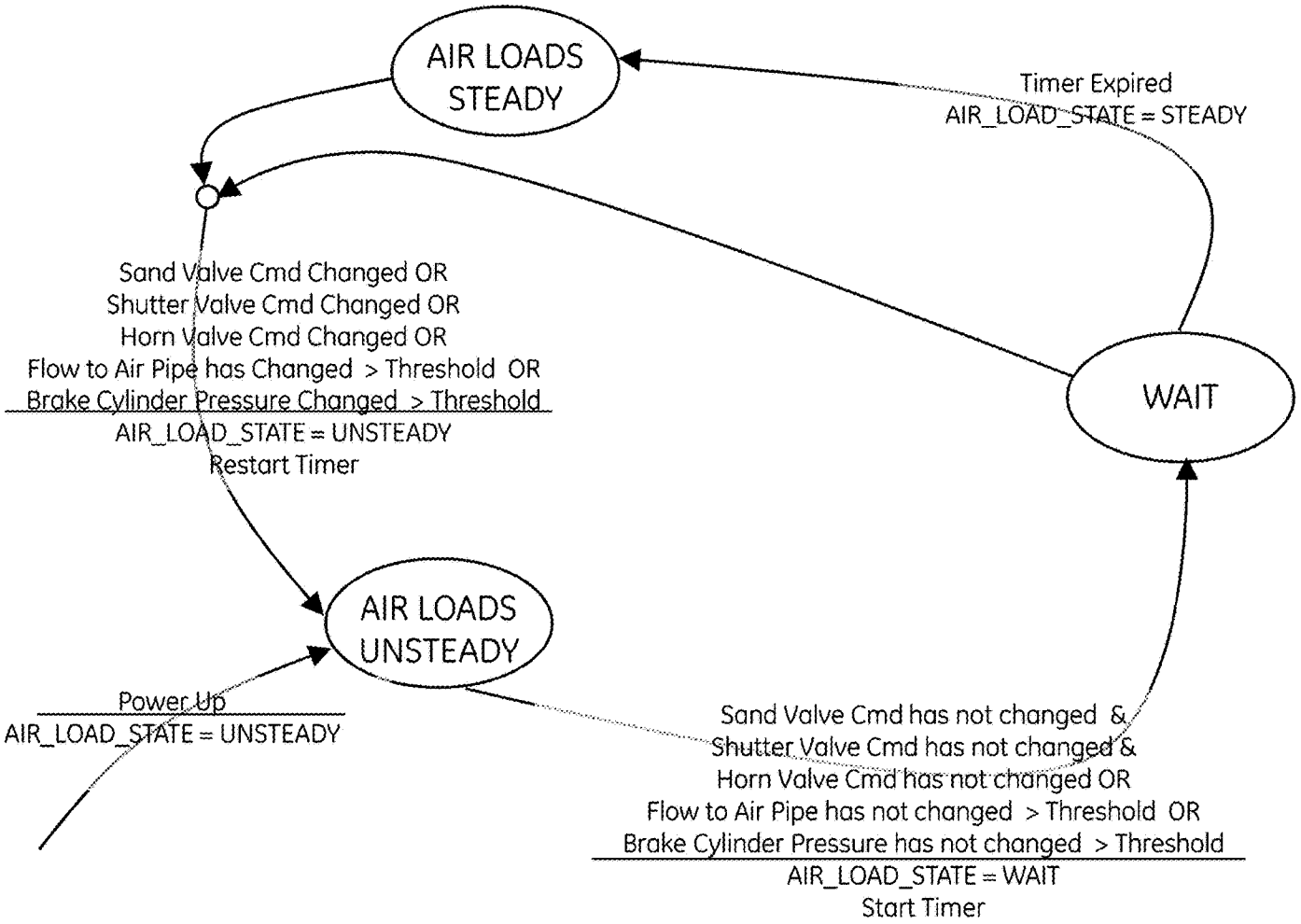
FIG. 28 is a state machine diagram illustrating a method for detecting the change in non-tractive effort system air flow, according to an embodiment of the present invention.
Figure 29:
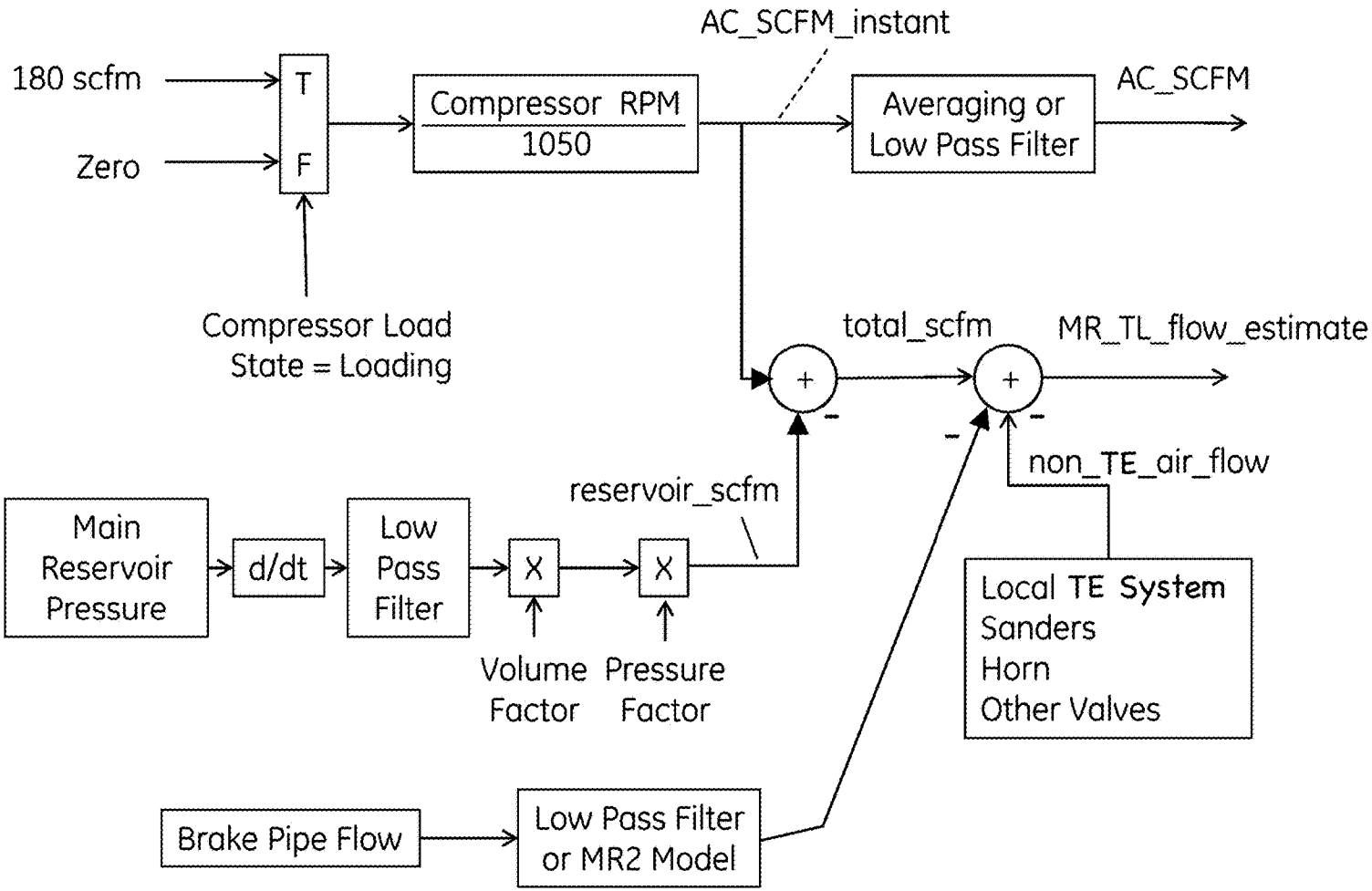
FIG. 29 is a flow diagram illustrating a method for estimating air compressor and tractive effort system flow, according to an embodiment of the present invention.
Figure 30:
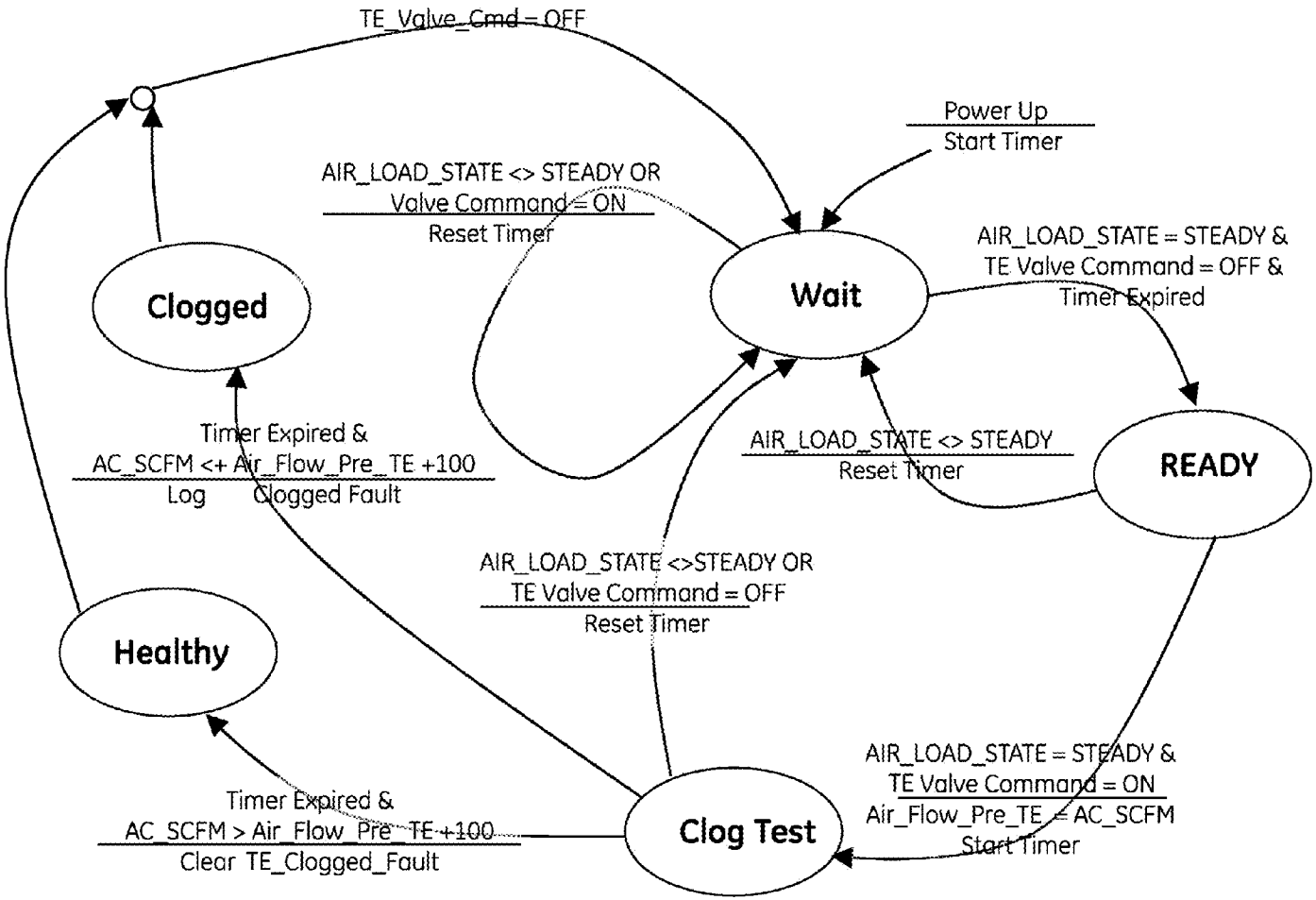
FIG. 30 is a state machine diagram illustrating a method for detecting clogs in a tractive effort system, in accordance with an embodiment of the present invention.

In an embodiment, as illustrated in FIG. 27, a method for detecting clogs in a tractive effort system on-board a rail vehicle includes comparing compressor air flow before ("baseline") and after ("secondary") the activation of the tractive effort system. Importantly, however, because there are other systems on board the consist that utilize compressed air, such as air brakes, sander control valves, horns, and other actuators, this flow comparison is best made when the state of these other devices is constant (and thus the air compressor load state is constant). In an embodiment, the compressor flow may be estimated in normalized volume rates. In another embodiment, the compressor flow may be estimated in mass flow based on compressor displacement and speed. FIG. 28 is a state machine diagram illustrating a method for detecting the change in non-tractive effort system air flow, i.e., for determining when the state of all air-consuming devices is constant and thus the air compressor load state is steady. FIG. 29 is a flow diagram illustrating a method for estimating air compressor and tractive effort system flow, as described above. FIG. 30 is a state machine diagram illustrating a method for detecting clogs in a tractive effort system.

As best shown in FIG. 30, a method for detecting clogs first includes the step of determining an air flow rate from the compressor to the main reservoir and a corresponding compressor load value under steady conditions. As used herein, steady conditions is intended to mean when the state of other air consuming devices is generally constant. This initial air flow rate and compressor load value/air load state may be referred to as a "baseline" air flow rate and baseline compressor load value/air load state. Once the air load state is steady, the tractive effort system is enabled by the control system for a predetermined period of time. At the expiration of this period, a secondary air flow rate and/or compressor load value is then assessed and compared to the baseline air flow rate and/or compressor load value. If the secondary air flow rate is greater than the baseline air flow rate plus a predetermined "buffer" (generally representing tractive effort system expected air flow), then the tractive effort system is diagnosed as "healthy" with respect to any clogs. If, however, the secondary air flow rate is less than the baseline air flow rate plus the "buffer," then the tractive effort system is diagnosed as "clogged." Based on this diagnosis, the control system may be configured to automatically disable the clogged tractive effort system and instead utilize another tractive effort system on-board another rail vehicle in its place.

In addition to detecting clogs within a tractive effort system by comparing compressor air flow before and after activation of the tractive effort system, system leaks may be diagnosed by detecting larger than expected compressor air flows when the system is activated as compared to when it is disabled. In an embodiment, the region where leaks can be detected is on the load side of the solenoid valve 50 as shown in FIG. 11. As will be readily appreciated, the detection of leaks within the system is important, as large leaks can tax the compressor to the point it cannot maintain system pressure above required levels.

Figure 31:
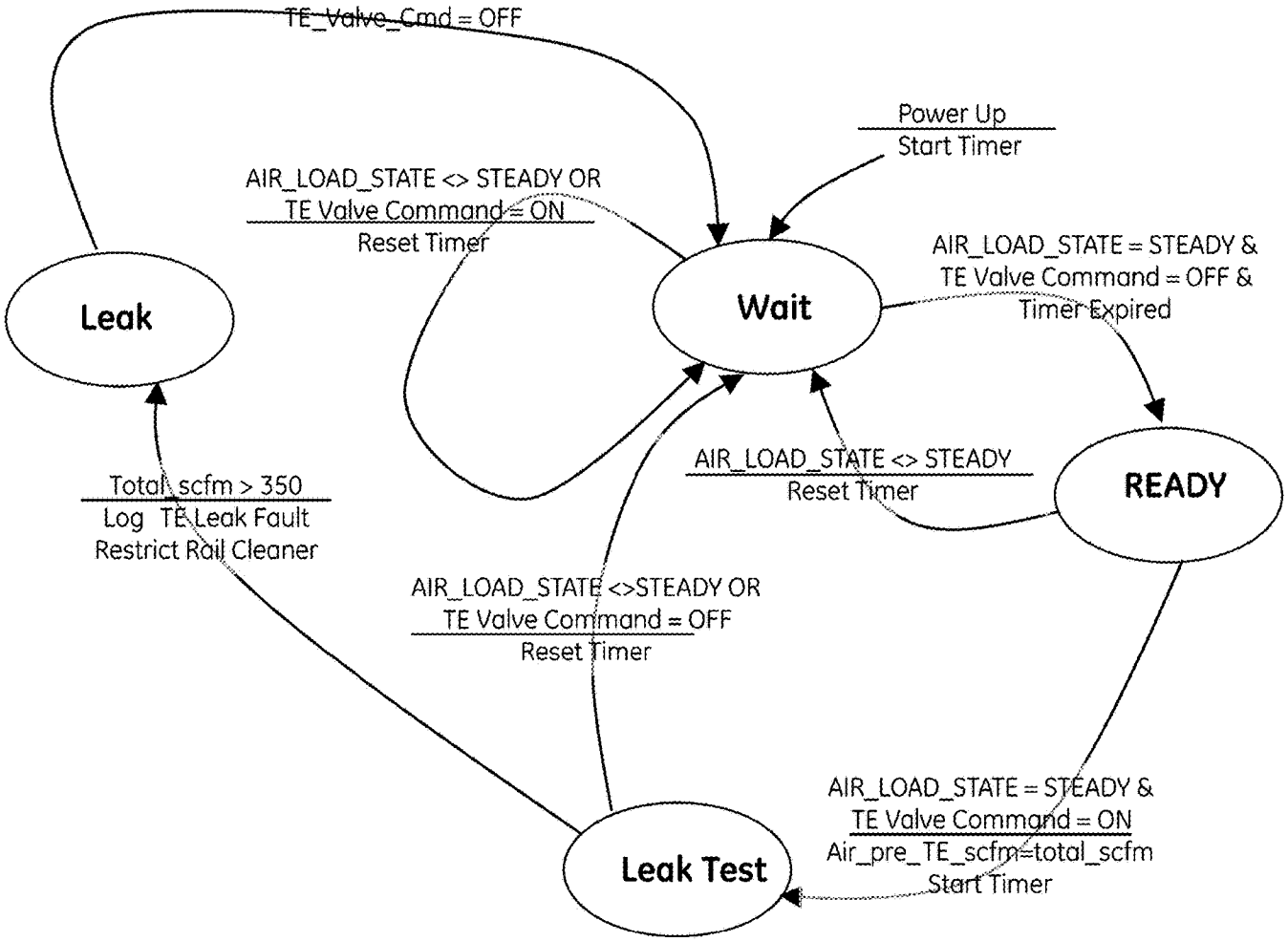
FIG. 31 is a state machine diagram illustrating a method for detecting leaks in a tractive effort system, in accordance with an embodiment of the present invention.

As illustrated by the state machine diagram of FIG. 31, a method for detecting leaks in a tractive effort system includes first ensuring that the air load state is "steady," as discussed above. Once the air load state is steady, the tractive effort system is enabled by the control system for a predetermined period of time. At the expiration of this period, a secondary air flow rate is measured. If the secondary air flow rate is greater than a predetermined threshold flow rate value based on the expected flow rate of the tractive effort system, a leak is diagnosed. If the secondary air flow rate is less than the predetermined threshold flow rate value, then the tractive effort system is diagnosed as "healthy" with respect to any leaks. If a leak is detected, the tractive effort system may be disabled or restricted in its use by the control system. In addition, based on this diagnosis, the control system may elect to utilize another tractive effort system within the consist in its place in accordance with the control logic described above.

In addition to the above, the present invention also provides a method for determining the effectiveness of a tractive effort system. In particular, the control system of the present invention is configured to automatically determine the impact of the tractive effort system on tractive effort and to take appropriate control action to accommodate the performance. As illustrated by the state machine diagram of FIG. 32, a method for determining the effectiveness of a tractive effort system includes enabling a tractive effort system for a predetermined travel distance. In an embodiment, the predetermined travel distance is at least 1 locomotive length. In an embodiment, the predetermined travel distance is more than 2 locomotive lengths. After the tractive effort system has been enabled for a predetermined travel distance, a first tractive effort is sampled, along with sand states, speed, notch, heading and curve measure. The tractive effort system is then disabled by the control system and a delay of approximately 2 locomotive lengths is initiated to allow for the impact of the tractive effort system to take effect. If speed has changed by more than approximately 2 miles per hour, notch has changed, or curvature has changed by more than approximately 3 degrees, then use of the tractive effort system is aborted. If not, a second tractive effort is sampled. The tractive effort of the system is then determined by subtracting the second tractive effort sampled value from the first tractive effort sample value. Depending on the outcome of this comparison, tractive effort system may be enabled once again to increase tractive effort.

Figure 32:
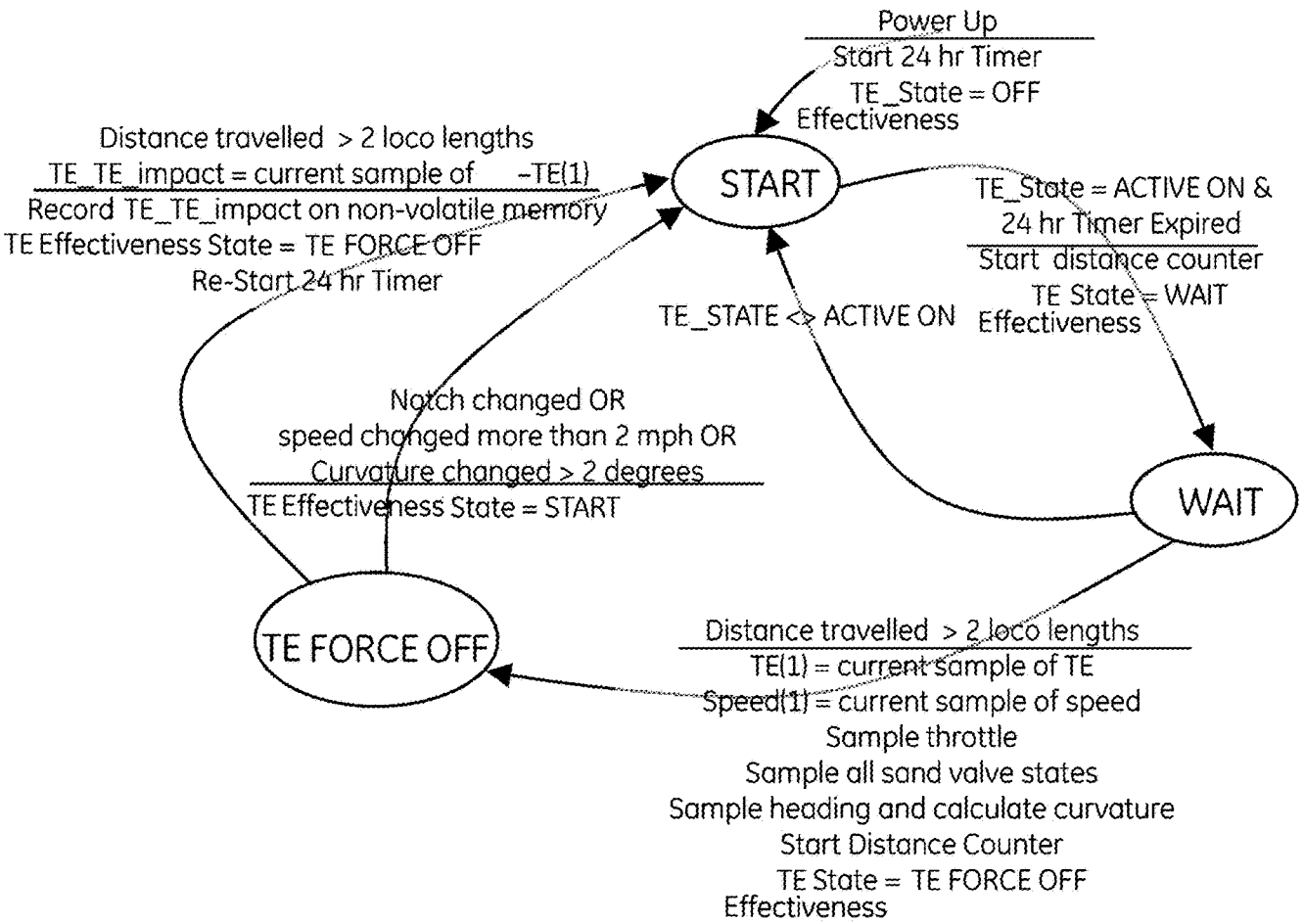
FIG. 32 is a state machine diagram illustrating a method for determining the effectiveness of a tractive effort system, in accordance with an embodiment of the present invention.
Figure 33:
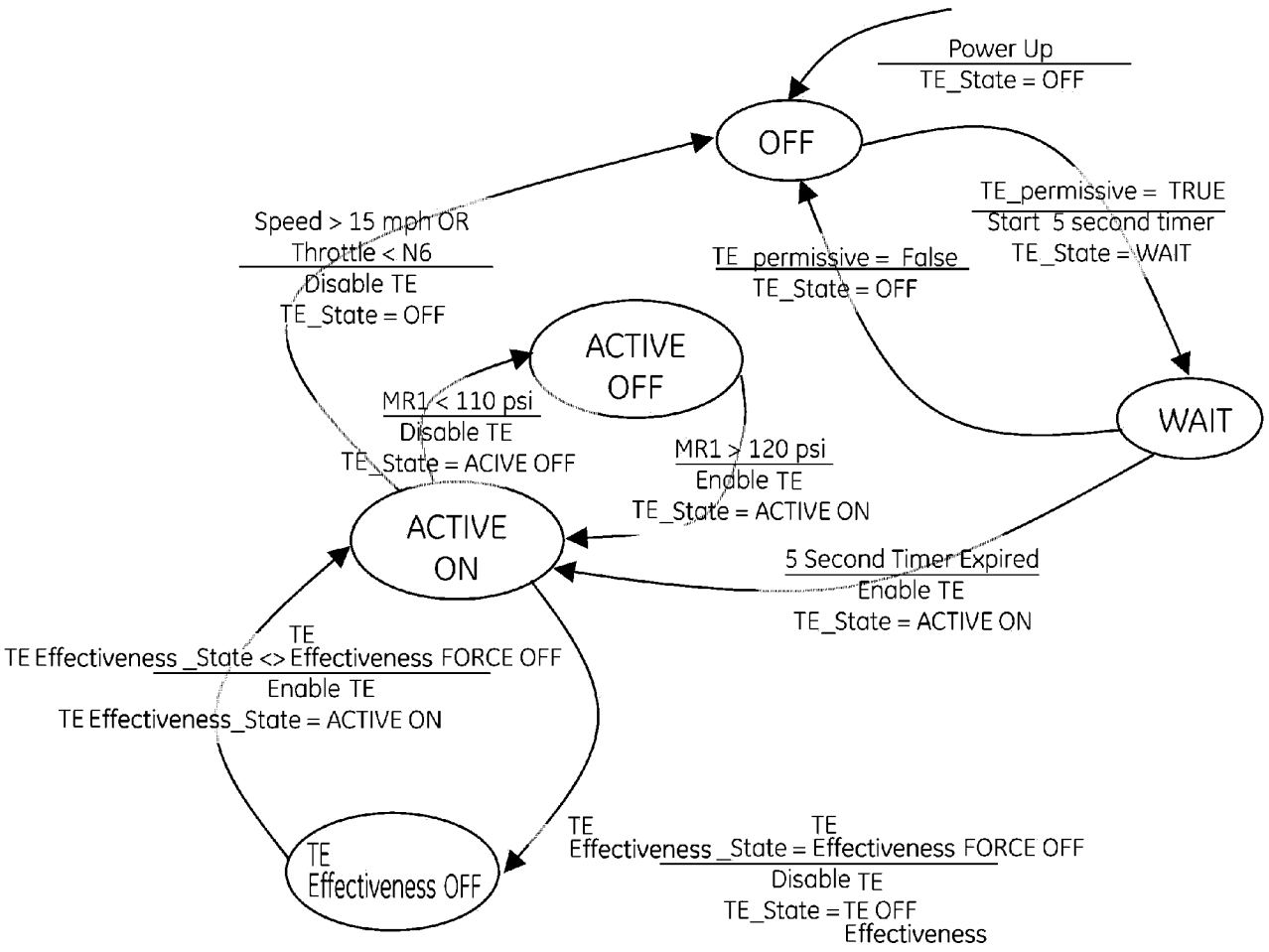
FIG. 33 is a state machine diagram illustrating a tractive effort system control strategy based upon a determined tractive effort system effectiveness, according to an embodiment of the present invention.

In an embodiment, the state machine for effectiveness detection illustrated in FIG. 32 may interact with a tractive effort system state machine, as shown in FIG. 33. In particular, this method for determining tractive effort system effectiveness may be utilized in connection with the smart-disable control strategy as shown in FIG. 20 and as discussed above. In this embodiment, if certain tractive effort system permissive conditions are met, such as speed is greater than approximately than 12 mph, throttle is approximately notch 7 or more, main reservoir pressure is greater than approximately 110 psi and either automatic or manual sand is enabled, then the tractive effort system is enabled after a predetermined delay. In an embodiment, the delay may be approximately 5 seconds. As shown therein, the tractive effort system may be maintained in its enabled state until the pressure in the main reservoir drops below approximately 110 psi. In an embodiment, the tractive effort system may be maintain in its enabled state until speed is greater than approximately 15 mph or throttle is approximately less than notch 6. Moreover, in an embodiment tractive effort system effectiveness may also be assessed and the system either disabled or maintained in an enabled state in dependence upon the determined effectiveness, as discussed above.

As will be readily appreciated, the ability to assess the effectiveness of a tractive effort system provides a number of advantages. In particular, assessment of the effectiveness provides performance information that can be used to aid in design improvements. In addition, defects or shortcomings in system effectiveness can be utilized to drive repair. Moreover, determining effectiveness of a tractive effort system allows a negative impact on tractive effort to be detected, such that a control action may be undertaken to disable the system until a period of time has elapsed or a change in location or rail condition has occurred, as hereinbefore discussed.

An embodiment of the present invention relates to a system for controlling a consist of rail vehicles or other vehicles. The system includes a control unit electrically coupled to a first rail vehicle in the consist, the control unit having a processor and being configured to receive signals representing a presence and position of one or more tractive effort systems on-board the first vehicle and other rail vehicles in the consist, and a set of instructions stored in a non-transient medium accessible by the processor, the instructions configured to control the processor to create a optimization schedule that manages the use of the one or more tractive effort systems based on the presence and position of the tractive effort systems within the consist. The control unit may be configured to maximize a supply of air to a lead-most tractive effort system. The control unit may configured to determine the presence of the one or more tractive effort systems on-board the rail vehicles in dependence upon at least one of air compressor speed and load state, reservoir pressure derivatives and a status of other loads within the rail vehicles. The control unit may be configured to detect the presence of a tractive effort system within the consist by estimating an air flow within a MRE pneumatic line. Moreover, the control unit may be configured to receive the signals representing the presence and position of one or more tractive effort systems on-board the rail vehicles via a communication link between the first rail vehicle and the other rail vehicles. The communication link may be a high-bandwidth communications link. The system may also include a compressed air reservoir fluidly coupled to one of the tractive effort systems for supplying compressed air, and the control unit may be configured to adjust the flow of compressed air from the reservoir to the tractive effort system to maintain a pressure within the reservoir above a lower threshold. The lower threshold may be approximately 110 psi. Alternatively, the control unit may be configured to enable one or more of the tractive effort systems until a pressure within the reservoir reaches a lower threshold pressure.

Another embodiment of the present invention relates to a method for optimizing a consist of at least first and second rail vehicles or other vehicles. The method includes the steps of determining a configuration of tractive effort systems within the consist and enabling the tractive effort systems in dependence upon the determined configuration to increase tractive effort. The method may also include the step of maximizing a flow of air to a lead-most tractive effort system. The step of determining the configuration of tractive effort systems within the consist may include estimating the flow of air through a MRE pneumatic line. Moreover, the method may include the step of adjusting a flow of air to one of the tractive effort systems to maintain a pressure within a compressed air reservoir above a lower threshold. The method may further include the step of, wherein the first and second rail vehicles each have a tractive effort system thereon, regulating the pressure in a compressed air reservoir of the second rail vehicle above approximately 140 psi (965 kPa) and regulating the pressure in a compressed air reservoir of the first rail vehicle above approximately 110 psi. The method may also include loading an air compressor to maximum flow.

Another embodiment of the present invention relates to a method of optimizing a flow of air to a tractive effort system of a rail vehicle or other vehicle. The method includes the steps of providing a supply of pressurized air from a reservoir to the tractive effort system, and varying the flow of air to the tractive effort system to maintain a pressure in the reservoir above a predetermined lower threshold. Varying the flow of air may include selectively directing the flow of air from the main reservoir through one of a first orifice and a second orifice in dependence on a detected air pressure in the reservoir, wherein the first orifice having a larger outlet area than the second orifice. Varying the flow of air may include selectively controlling a size of an orifice in an air flow path between the reservoir and a nozzle of the tractive effort system in dependence upon an available air pressure in the reservoir. The size of the orifice may be controlled by a continuously variable orifice valve. The pressure in the reservoir may also be maintained above the predetermined lower threshold through the use of a secondary dedicated air compressor.

Another embodiment of the present invention relates to a system for control of a rail vehicle or other vehicle. The system includes a tractive effort device having a nozzle positioned to direct a flow of air to a rail, a reservoir fluidly coupled to the tractive effort device for providing a supply of compressed air to the tractive effort device, and a control unit electrically coupled to the tractive effort device and configured to control a flow of compressed air from the reservoir to the tractive effort device in dependence upon an available pressure within the reservoir. The system may also include a continuously variable orifice positioned between the reservoir and the nozzle of the tractive effort device. With this configuration, the control unit may be further configured to control the size of the orifice in dependence upon the pressure within the reservoir. Moreover, the system may include a first pathway from the reservoir to the tractive effort device, the first pathway having a first orifice therein and a first control valve for selectively controlling a flow of air through the first orifice, and a second pathway form the reservoir to the tractive effort device, the second pathway having a second orifice therein and a second control valve for selectively controlling a flow of air through the second orifice, the second orifice being smaller than the first orifice. In this configuration, the control unit may be electrically coupled to the first and second control valves for selectively controlling the first and second control valves between a first state, in which air is permitted to flow therethrough, and a second state, in which air is prevented from flowing therethrough. The system may include a first air compressor fluidly coupled to the reservoir for supplying the reservoir with compressed air and a second air compressor configured to supply the reservoir with compressed air in dependence upon the available pressure within the reservoir.

Yet another embodiment of the present invention relates to a system for use with a vehicle having a wheel that travels on a surface, e.g., a rail vehicle having a wheel that travels on a rail. The system includes a tractive effort system including an air source for supplying compressed air and a nozzle fluidly coupled to the air source and configured to direct a flow of compressed air from the air source to a contact surface of the rail, and a control unit electrically coupled to the tractive effort system and configured to control the tractive effort system between an enabled state, in which compressed air flows from the air source and out of the nozzle of the tractive effort system, and a disabled state, in which compressed air is prevented from exiting the nozzle. The control unit is further configured to control the tractive effort system from the enabled state to the disabled state in dependence upon the presence of at least one adverse condition. The at least one adverse condition may be a geographic location of the rail vehicle, a curve radius of the rail below a predetermined radius threshold, the presence of at least one of snow, dust or debris on a roadbed adjacent the rail, and/or determined ineffectiveness of tractive effort enhancement.

Yet another embodiment of the present invention relates to a method for controlling a rail vehicle or other vehicle. The method includes providing a tractive effort system having a nozzle for directing the flow of compressed air to the contact surface of a rail and disabling the tractive effort system when an adverse condition is detected. The adverse condition may be one of a geographic location of the rail vehicle, a curve radius of the rail below a predetermined threshold, a calculated ineffectiveness of the tractive effort system and a detection of debris on a roadbed adjacent the rail.

Another embodiment relates to a system for use with a vehicle having a wheel that travels on a surface, e.g., a rail vehicle having a wheel that travels on a rail. The system includes an air source for supplying compressed air, a nozzle fluidly coupled to the air source and configured to direct a flow of compressed air from the air source to a contact surface of the rail, a valve positioned intermediate the air source and the nozzle, the valve being controllable between a first state in which the compressed air flows from the air source to the nozzle, and a second, disabled state in which the compressed air is prevented from flowing to the nozzle, a controller for controlling the valve between the first state and the second, disabled state, and an operator interface electrically coupled to the controller, the operator interface including a momentary disable switch biased to a position that controls the valve to the first state and movable against the bias to control the valve to the second, disabled state. The operator interface may also include a monostable button actuatable to selectively toggle the valve between the first state and the second, disabled state. The controller may be configured to automatically control the valve to the first state after a predetermined period of time has elapsed, a certain distance has been traversed, a certain throttle transition has occurred, a certain vehicle speed change has occurred and/or a certain tractive effort level has been attained.

Another embodiment relates to a system for controlling a consist of vehicles having a plurality of wheels that travel on a surface, e.g., a consist of rail vehicles having a plurality of wheels that travel on a rail. The system includes a tractive effort system on-board a first rail vehicle. The tractive effort system includes a media reservoir capable of holding a tractive material, a tractive material nozzle in communication with the media reservoir and configured to direct a flow of tractive material to a contact surface of the rail, a compressed air reservoir, and a compressed air nozzle in communication with the compressed air reservoir and configured to direct a flow of compressed air to the contact surface of the rail. The system further includes a control unit electrically coupled to a first rail vehicle in the consist, the control unit having a processor and being configured to receive signals indicative of slippage, individual axle tractive effort, overall rail vehicle tractive effort and horsepower. The control unit is further configured to control the tractive effort system to apply compressed air only to the contact surface of the rail and monitor at least one of slippage, individual axle tractive effort, overall rail vehicle tractive effort and horsepower after application of the compressed air only. The control unit may be configured to control the tractive effort system to apply tractive material to the contact surface of the rail as a backup to the application of compressed air only in dependence upon at least one of rail vehicle speed and rail vehicle tractive effort. The control unit may be configured to control the tractive effort system to apply tractive material to the contact surface of the rail as a backup to the application of compressed air only in dependence upon at least one of elapsed time since tractive effort system activation, distance traversed since tractive effort system activation, geographical location, operator input and measured or inferred tractive material reservoir levels.

Another embodiment of the present invention relates to a method for controlling a rail vehicle or other vehicle having a tractive effort system. The method includes the steps of enabling the tractive effort system to apply a blast of air only to the rail, monitoring one of slip, individual axle tractive effort, overall tractive effort and horsepower, and enabling the tractive effort system to apply tractive material to the rail in dependence upon at least one parameter. The at least one parameter may be a speed of the rail vehicle, a tractive effort of the rail vehicle, a distance traveled since the tractive effort system was enabled, and/or measured or inferred tractive material level.

Another embodiment relates to a method of controlling a rail vehicle or other vehicle. The method comprises providing a supply of pressurized air from a reservoir to a tractive effort system of the rail vehicle, and varying the flow of air to the tractive effort system to maintain a pressure in the reservoir above a predetermined lower threshold.

In another embodiment of the method, varying the flow of air includes selectively controlling a size of an orifice in an air flow path between the reservoir and a nozzle of the tractive effort system in dependence upon an available air pressure in the reservoir. The size of the orifice may be controlled by a continuously variable orifice valve.

An embodiment relates to a traction system for a vehicle. The traction system includes a nozzle coupled to an air source and configured to be selectively aimed toward a determined portion of a rail surface of a rail. The determined portion is based on a location of the rail surface between edges of the rail and proximate to a wheel of the vehicle. The traction system further includes a conduit, such as a pipe, tube, or hose, configured to supply pressurized air from the air source to the nozzle, the nozzle flexibly coupled thereto. The nozzle is configured for the aim of the nozzle to be controlled to change its aiming direction in response to a change in curvature of the rail, whereby a stream of air from the nozzle impacts the determined portion during movement of the vehicle through the curvature of the rail.

The traction system may further comprise an actuator that is configured to force the nozzle aiming direction in response to the change in the curvature of the rail. In an example, the actuator includes an electromagnet that is coupled to the nozzle. The electromagnet may be coupled to a voltage source and may be energized from the voltage source responsive to a signal from an electronic controller.

The flexible coupling of the nozzle may be provided by a lever bracket mounted to a frame of the vehicle and mounted to the conduit, and the traction system may further comprise a resilient member coupled between the lever bracket and a journal bearing housing of a lead axle of the vehicle. The lever bracket transforms lateral movement of the frame relative to the lead axle in a first direction to lateral movement of the nozzle in a second, opposite direction, as the curvature of the rail changes.

The traction system may further comprise a sensor that tracks the rail for curvature, and an actuator configured to actuate the nozzle to change the aiming direction to maintain the impact of the air stream on the rail portion during a curve. In examples, the nozzle is positioned to point at a location in front of a lead wheel of the vehicle, such that the nozzle is configured to direct a stream of pressurized air to a point on the rail proximate where the lead wheel contacts the rail. In examples, the conduit is coupled to a journal bearing housing of a lead axle of the vehicle. In an example, the air source is configured to provide air at a pressure of greater than 620 kPa sufficient to provide the air stream at a velocity of greater than 23 meters per second sufficient to increase the tractive effort of the wheel on the rail.

An embodiment of a system for a vehicle includes a passage configured to receive pressurized air and coupled to a support of a lead axle of the vehicle; a nozzle coupled to the passage and configured to direct the pressurized air to a surface over which the vehicle is traveling; and a tracking mechanism to adjust one or more of a position of the nozzle or an angle of the nozzle relative to the support as a relative direction of travel between the vehicle and the surface changes.

In an example, the passage may be comprised of a flexible material and the tracking mechanism may comprise an electromagnet coupled to the nozzle, the electromagnet configured to be energized when the surface changes direction in order to adjust one or more of the position or the angle of the nozzle.

In an example, the tracking mechanism may comprise a lever bracket coupled to the passage at a first end and to a frame of the vehicle at a second end. The frame of the vehicle may be configured to move laterally with respect to the support as the relative direction of travel between the vehicle and the surface changes, and the lever bracket is configured to transfer the lateral movement to the passage in order to adjust one or more of the position or the angle of the nozzle. In one example, the lever bracket extends horizontally relative to the frame, and the support comprises a journal bearing housing. In another example, the lever bracket extends vertically relative to the frame.

In an embodiment, a method for a vehicle includes directing a stream of pressurized air via a nozzle to a defined portion of a surface of a rail over which the vehicle is traveling; and adjusting an aiming direction of the nozzle based on a curvature of the surface of the rail.

In an example, adjusting the aiming direction of the nozzle based on the curvature of the surface of the rail comprises transferring relative movement between a wheel axle and truck frame of the vehicle to the nozzle. In an example, adjusting the aiming direction of the nozzle based on the curvature of the surface of the rail comprises energizing an electromagnet coupled to the nozzle. In an example, directing pressurized air onto the rail comprises directing pressurized air onto the rail responsive to a detection of wheel slip.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for a vehicle, comprising:

a passage configured to receive pressurized air and coupled to a support of a lead axle of the vehicle;

a nozzle coupled to the passage and configured to direct the pressurized air to a surface over which the vehicle is traveling; and a tracking mechanism to adjust one or more of a position of the nozzle or an angle of the nozzle relative to the support as a relative direction of travel between the vehicle and the surface changes;

wherein the tracking mechanism comprises a lever bracket coupled to the passage at a first end and to a frame of the vehicle at a second end, and wherein the frame of the vehicle is configured to move laterally with respect to the support as the relative direction of travel between the vehicle and the surface changes, and wherein the lever bracket is configured to transfer the lateral movement to the passage in order to adjust the one or more of the position or the angle of the nozzle.

2. The system of claim 1, wherein the lever bracket extends horizontally relative to the frame, and wherein the support comprises a journal bearing housing.

3. The system of claim 1, wherein the lever bracket extends vertically relative to the frame.

4. The system of claim 1, wherein the lever bracket is coupled to the support by a bellows.

5. A system for a vehicle, comprising:

a passage configured to receive pressurized air and coupled to a support of a lead axle of the vehicle;

a nozzle coupled to the passage and configured to direct the pressurized air to a surface over which the vehicle is traveling; and a tracking mechanism to adjust one or more of a position of the nozzle or an angle of the nozzle relative to the support as a relative direction of travel between the vehicle and the surface changes;

wherein the passage is comprised of a flexible material and wherein the tracking mechanism comprises an electromagnet coupled to the nozzle, the electromagnet configured to be energized when the surface changes direction to move the nozzle and flexible passage in order to adjust one or more of the position or the angle of the nozzle.

6. The system of claim 5, wherein the electromagnet is annular and surrounds an opening of the nozzle.

7. A method for a vehicle, comprising:

with a passage coupled to a support of a lead axle of the vehicle, receiving pressurized air;

with a nozzle coupled to the passage, directing the pressurized air to a surface over which the vehicle is traveling; and with a tracking mechanism, adjusting one or more of a position of the nozzle or an angle of the nozzle relative to the support as a relative direction of travel between the vehicle and the surface changes;

wherein the passage is comprised of a flexible material, wherein the tracking mechanism comprises an electromagnet coupled to the nozzle, and wherein adjusting the one or more of the position of the nozzle or the angle of the nozzle comprises energizing the electromagnet when the surface changes direction to move the nozzle and flexible passage.

8. The method of claim 7, wherein the tracking mechanism comprises a lever bracket coupled to the passage at a first end and to a frame of the vehicle at a second end.

9. The method of claim 8, wherein adjusting the one or more of the position of the nozzle or the angle of the nozzle comprises:

with the frame of the vehicle, moving laterally with respect to the support as the relative direction of travel between the vehicle and the surface changes; and with the lever bracket, transferring the lateral movement to the passage.

10. The method of claim 8, wherein the lever bracket extends horizontally relative to the frame, and wherein the support comprises a journal bearing housing.

11. The method of claim 8, wherein the lever bracket extends vertically relative to the frame.

12. The method of claim 7, wherein the electromagnet is annular and surrounds an opening of the nozzle.

13. A system for a vehicle, comprising:

a frame, a support attached to the frame, a lead axle supported by the support, and two wheels attached to the lead axle, the lead axle and attached wheels configured to shift laterally relative to the frame as a relative direction of travel between the vehicle and a surface over which the vehicle is traveling changes;

a passage configured to receive pressurized air and coupled to the support;

a nozzle coupled to the passage and configured to direct the pressurized air to the surface; and a tracking mechanism configured to adjust one or more of a position of the nozzle or an angle of the nozzle relative to the support as the relative direction of travel between the vehicle and the surface changes;

wherein the tracking mechanism comprises a lever bracket coupled to the support and to at least one of the passage or the nozzle, and the lever bracket is further coupled to the frame such that lateral shifting of the axle and wheels relative to the frame as the relative direction of travel between the vehicle and the surface changes causes the lever bracket to move with respect to the support, in order to adjust the one or more of the position or the angle of the nozzle.

* * * * *